US008128446B2

(12) United States Patent
Honda et al.

(10) Patent No.: US 8,128,446 B2
(45) Date of Patent: Mar. 6, 2012

(54) METHOD FOR MANUFACTURING A SPARK PLUG INSULATOR INCLUDING STEPS FOR FORMING A THROUGH HOLE THEREIN

(75) Inventors: Toshitaka Honda, Aichi (JP); Takamitsu Mizuno, Gifu (JP); Shinichi Sakurai, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 290 days.

(21) Appl. No.: 12/405,462

(22) Filed: Mar. 17, 2009

(65) Prior Publication Data

US 2009/0239437 A1 Sep. 24, 2009

(30) Foreign Application Priority Data

Mar. 19, 2008 (JP) ..... P2008-072000
Dec. 25, 2008 (JP) ..... P2008-329107

(51) Int. Cl.
*H01T 21/02* (2006.01)
*F02B 19/00* (2006.01)

(52) U.S. Cl. ..... 445/7; 123/143 B

(58) Field of Classification Search ..... None
See application file for complete search history.

(56) References Cited

U.S. PATENT DOCUMENTS

| | | | | |
|---|---|---|---|---|
| 3,034,191 | A | 5/1962 | Schaefer et al. | 425/78 |
| 3,337,668 | A | 8/1967 | Möhle | 264/120 |
| 4,097,977 | A | 7/1978 | Pollner | 29/25.12 |
| 6,274,971 | B1 | 8/2001 | Sugimoto et al. | 313/143 |
| 6,680,561 | B2 | 1/2004 | Yamaguchi et al. | 313/118 |
| 2009/0215348 | A1 * | 8/2009 | Honda et al. | 445/7 |
| 2009/0302733 | A1 * | 12/2009 | Nunome et al. | 313/141 |

FOREIGN PATENT DOCUMENTS

| | | |
|---|---|---|
| EP | 1 837 965 | 9/2007 |
| JP | S53-1732 | 1/1978 |
| JP | 60-262375 | 12/1985 |
| JP | 4-92384 | 3/1992 |
| JP | 4-092385 | 3/1992 |
| JP | 43-28352 | 11/1992 |
| JP | 6-325854 | 11/1994 |
| JP | 2000-48931 | 2/2000 |
| JP | 2000058226 A * | 2/2000 |
| JP | 2000-315563 | 11/2000 |
| JP | 2003-142224 | 5/2003 |

OTHER PUBLICATIONS

Notification of Reasons for Refusal (dated Dec. 8, 2009) issued in connection with corresponding Japanese Patent Application No. P2008-329107, with English translation.

(Continued)

*Primary Examiner* — Toan Ton
*Assistant Examiner* — Britt D Hanley
(74) *Attorney, Agent, or Firm* — Kusner & Jaffe

(57) ABSTRACT

A method for manufacturing an insulator for a spark plug is provided. The method includes: a preparing step; a press pin arranging step; a powder filling step after the press pin arranging step; a cavity blocking step after the powder filling step; a compression molding step after the cavity blocking step; a die releasing step after the compression molding step; and a press pin removing step after the die releasing step.

9 Claims, 15 Drawing Sheets

OTHER PUBLICATIONS

Notification of Reasons for Refusal (dated Jun. 1, 2010) issued in connection with corresponding Japanese Patent Application No. 2008-329107, with English translation.

Notification of First Office Action (dated Apr. 6, 2011) issued in connection with corresponding Chinese Patent Application No. 200910129239.8, with English translation.

European Search Report (dated Apr. 21, 2011) issued in connection with corresponding European Patent Application No. 09155653.0.

Notification of Reason for Refusal (dated Nov. 8, 2011) issued in connection with corresponding Japanese Patent Application No. 2010-023068, with English translation.

Notification of Reasons for Refusal (dated Dec. 27, 2011) issued in connection with corresponding Japanese Patent Application No. 2010-023067, with English translation.

* cited by examiner

METHOD FOR MANUFACTURING A SPARK PLUG INSULATOR INCLUDING STEPS FOR FORMING A THROUGH HOLE THEREIN

FIELD OF THE INVENTION

The present invention relates to an insulator for a spark plug, and a method for manufacturing the spark plug.

BACKGROUND OF THE INVENTION

FIGS. 2 to 6 of Japanese Patent Document JP-A-2000-315563 discloses a method for manufacturing an insulator for a spark plug. This manufacturing method forms a through hole in the insulator for inserting a center electrode and a terminal electrode in an axial direction.

In this manufacturing method, first, as a preparing step, a press pin used to form the through hole is prepared and a forming die is prepared that has a cavity in which an opening is formed on the rear end side in the axial direction. The press pin is formed at a rear end thereof with a rib-shaped pin-side spiral portion which turns spirally around its own outer peripheral surface.

Next, as a powder filling step, green powder is loaded and filled into the cavity from the opening. Next, as a press pin arranging step after the powder filling step, the press pin is arranged within the cavity by moving the press pin toward a tip side of the forming die in the axial direction from the opening. As a cavity blocking step after the press pin arranging step, the opening is blocked by a blocking member. Then, as a compression molding step, the green powder within the cavity is pressed along with the press pin to obtain a compact (i.e., compact piece).

As a die releasing step after the compression molding step, the compact along with the press pin are removed from the cavity. As a press pin removing step after the die releasing step, the press pin is pulled out of the compact. The compact obtained in this way has an external shape corresponding to an insulator for a spark plug. Grinding is performed on this compact to form a green (non-sintered) insulator.

Then, the green insulator is sintered at a temperature of 1400° C. to 1650° C. Thereby, a pinhole formed by the press pin becomes the through hole. Then, the sintered insulator is coated with glaze and finish-sintered to provide an insulator for a spark plug. This insulator for a spark plug is assembled together with a center electrode, a terminal electrode, a metal shell, and a resistor, and becomes a spark plug. This spark plug is attached to an engine by a threaded portion of the metal shell, and is used as an igniting source for an air-fuel mixture supplied to a combustion chamber.

The diameter of the spark plug tends to decrease in order to save space, and thus the diameter of an insulator for the spark plug is correspondingly required to become smaller. For this reason, it is necessary to decrease the diameter of the through hole of the insulator for the spark plug. Thus, the insulator for the spark plug should be manufactured using the press pin whose diameter is small. However, in the above manufacturing method, when an insulator for a spark plug is manufactured using the press pin whose diameter is small, the press pin may be bent due to the resistance which the press pin receives from the green powder within the cavity in the press pin arranging step after the powder filling step. In this case, the pinhole of the compact does not extend straight in the axial direction, and thus the through hole of the insulator for the spark plug does not extend straight in the axial direction. For this reason, the insulator for the spark plug may become a defective article, or replacement of the press pin should be required frequently, and thus cause an increase in manufacturing costs.

SUMMARY OF THE INVENTION

The present invention was made in view of the above-noted and/or other circumstances.

As one of illustrative, non-limiting embodiments, the present invention can provide a method for manufacturing an insulator for a spark plug. The method includes: a preparing step; a press pin arranging step; a powder filling step after the press pin arranging step; a cavity blocking step after the powder filling step; a compression molding step after the cavity blocking step; a die releasing step after the compression molding step; and a press pin removing step after the die releasing step.

Accordingly, as one of the advantages, the present invention can provide a method for manufacturing an insulator for a spark plug, which can use a press pin of a small diameter. As another one of the advantages, the present invention can provide a method for manufacturing an insulator for a spark plug, in which bending of the press pin is prevented. As yet another one of the advantages, the present invention can provide a method for manufacturing an insulator for a spark plug, which can guarantee high yield. As still another one of the advantages, the present invention can provide a method for manufacturing an insulator for a spark plug, which can realize a low manufacturing cost.

These and other advantages of the present invention will be discussed in detail with reference to the accompanying drawings.

DESCRIPTION OF THE PREFERRED EMBODIMENT

Figure 1:
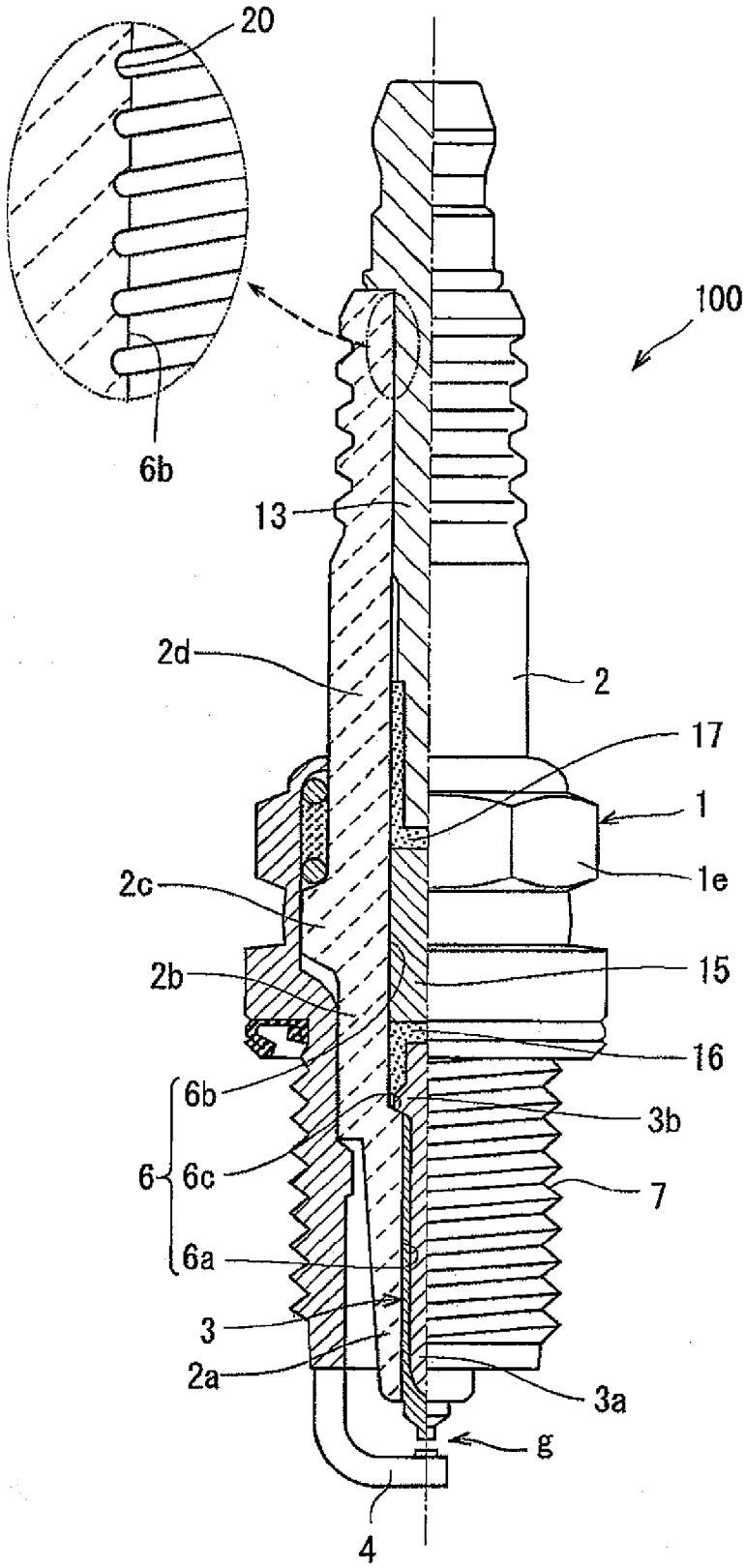
FIG. 1 is a front view (partially sectional view) of a spark plug having an insulator manufactured according to a method of an embodiment 1 of the present invention.

Hereinafter, exemplary embodiments 1 to 3 for carrying out the present invention will be described, with reference to the drawings. In addition, in respective drawings (excluding FIG. 10), a vertical direction is defined as an axial direction, the lower side of each of a spark plug 100, a press pin 50, 250, a die 80, a cavity 83, and an insulator 2 for a spark plug is defined as the tip side, and similarly, the upper side of each is defined as the rear end side. These terms are intended to facilitate the understanding of the present invention, and should not be interpreted in a restrictive sense.

Embodiment 1

A manufacturing method of embodiment 1 is a method of manufacturing the insulator 2, which is an insulator for a spark plug. Since the insulator 2 is included in the spark plug 100, first, the entire configuration of the spark plug 100 will be described.

The spark plug 100 includes a tubular metal shell 1, an insulator 2 fitted into the metal shell 1 such that its tip protrudes, a center electrode 3 provided inside the insulator 2 in a state where its tip protrudes, and a grounding electrode 4 arranged such that one end is connected to the metal shell 1 by welding or the like, and the other end is bent laterally such that a side surface of the other end faces a tip portion of the center electrode 3.

A spark discharge gap g is formed between the grounding electrode 4 and the center electrode 3. The metal shell 1 is formed in a tubular shape from metal, such as low-carbon steel, and forms a housing of the spark plug 100. The outer peripheral surface of the metal shell 1 is formed with a threaded portion 7 and a tool engaging portion 1*e*. The threaded portion 7 is used to attach the spark plug 100 to an engine, which is not shown. The tool engaging portion 1*e* has a hexagonal axial cross-sectional shape for engagement with a tool, such as a spanner or a wrench when the metal shell 1 is attached to the engine. The center electrode 3 and the grounding electrode 4 are made of an Ni alloy or the like, and a core material 3*a*, such as Cu or a Cu alloy, for promotion of heat radiation, may be embedded if necessary.

The insulator 2 is made of an insulating material which includes mainly alumina or the like. The insulator 2 is formed with a through hole 6 extending in an axial direction. The center electrode 3 is inserted into and fixed to the through hole 6 on the tip side thereof, and the terminal electrode 13 is inserted into and fixed to the through hole 6 on the rear end side thereof. A resistor 15 is arranged between the terminal electrode 13 and the center electrode 3 within the through hole 6. Both ends of the resistor 15 are electrically connected to the center electrode 3 and the terminal electrode 13, respectively, via conductive glass seal layers 16 and 17. The resistor 15 is formed from a resistor composition obtained by mixing glass powder and conductive powder (and if required, ceramic powder other than glass) and sintering the resulting mixture by a hot press or the like.

The diameter of the center electrode 3 (in a cross-section orthogonal to the axial direction) is set to be smaller than the diameter of the resistor 15. The through hole 6 has a first portion 6*a* and a second portion 6*b*, each in the form of a hole having a circular cross-sectional shape. The second portion 6*b* is arranged on the rear side (on the upper side in the drawing) of the first portion 6*a* and has a larger diameter than the first portion 6*a*. The terminal electrode 13 and the resistor 15 are accommodated within the second portion 6*b*, and the center electrode 3 is inserted into the first portion 6*a*. A rear end of the center electrode 3 is formed with an electrode-fixing lug 3*b* which protrudes outward from an outer peripheral surface thereof. A lug-receiving surface 6*c* for receiving the electrode-fixing lug 3*b* of the center electrode 3 is formed in the form of a tapered surface or an arcuate surface in a connecting position between the first portion 6*a* and the second portion 6*b* of the through hole 6.

In order to make it easy to extract the press pin 50 which will be described later, an extraction taper (for example, about 5/1000 to 5/100) which has a larger diameter toward the rear side in the axial direction is given to an inner peripheral surface of the second portion 6*b* of the through hole 6. On the other hand, an extraction taper with a smaller angle than the second portion 6*b* is given to an inner peripheral surface of the first portion 6*a*, or an extraction taper is not substantially given to the inner peripheral surface of the first portion 6*a*.

In addition, if specific dimensions of an external shape of the insulator 2 are exemplified, the total length of the insulator 2 is, for example, 30 to 75 mm, the mean inner diameter of the second portion 6*b* of the through hole 6 is about 2 to 5 mm, and similarly, the mean inner diameter of the first portion 6*a* is, for example, about 1 to 3.5 mm. In order to save the space for the spark plug 100 or improve the performance thereof, such as a heat generation characteristic, the diameter of the insulator 2 is made smaller.

Next, a method for manufacturing the insulator 2 will be described. The above-mentioned insulator 2 is manufactured by the manufacturing method including a preparing step, a press pin arranging step, a powder filling step, a cavity blocking step, a compression molding step, a die releasing step, and a press pin removing step in this order. Hereinafter, each of the steps will be described.

Preparing Step

In the preparing step, the press pin 50 and the forming die 80 are prepared.

Figure 2:
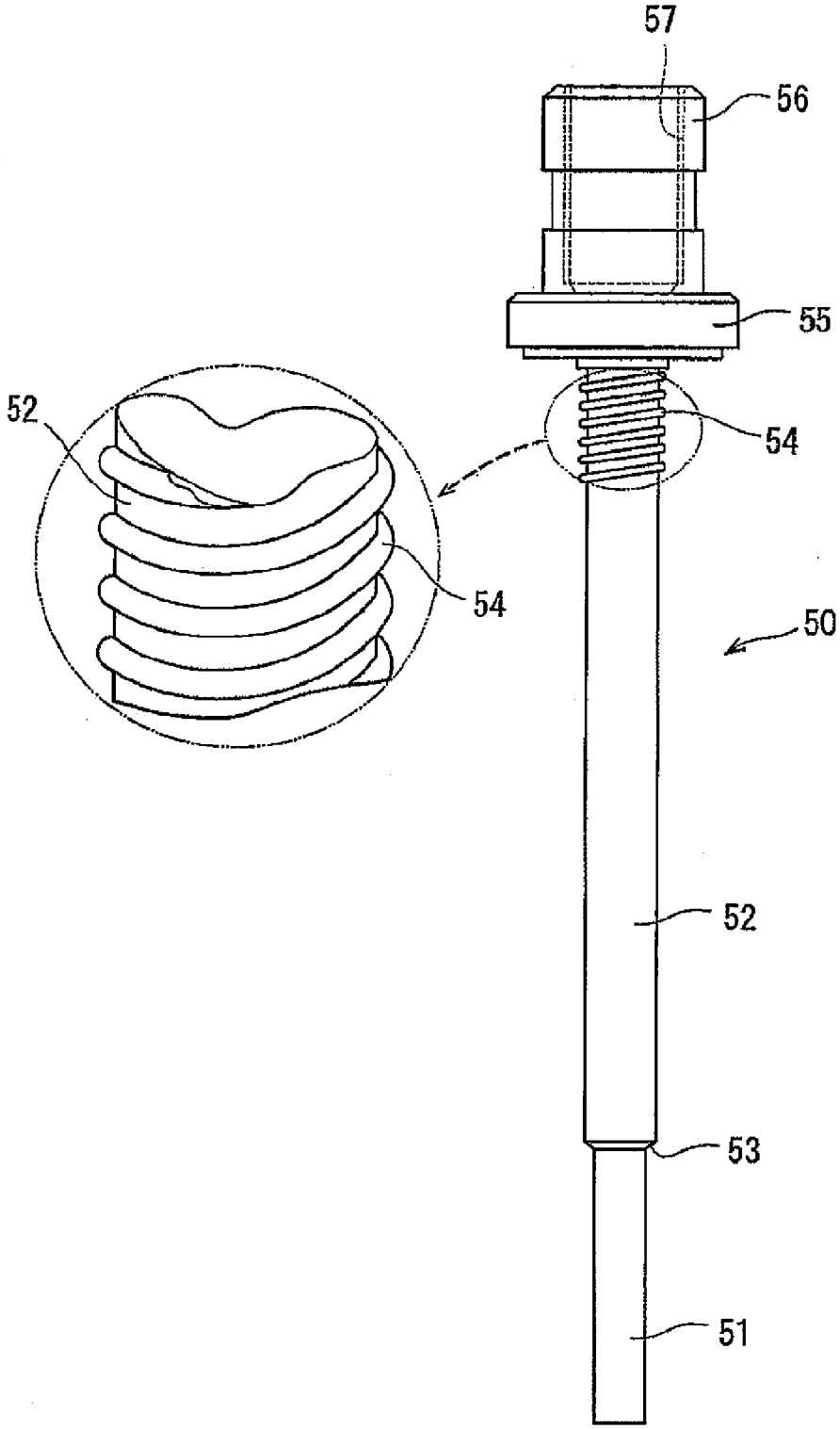
FIG. 2 is a front view of a press pin used in the method of the embodiment 1 of the present invention.

The press pin 50, as shown in FIG. 2, is a metallic shaft member used in order to form the through hole 6. In more detail, the press pin 50 is formed with a first shaft portion 51 for forming the first portion 6*a* of the through hole 6 of FIG. 1 on the tip side and a second shaft portion 52 for forming the second portion 6*b* of the through hole 6. The second shaft portion 52 is continuous from the rear side of the first shaft portion 51. A stepped portion 53 corresponding to the lug-receiving surface 6*c* of the through hole 6 of FIG. 1 is formed between the first shaft portion 51 and the second shaft portion 52.

An extraction taper (for example, about 5/1000 to 5/100 corresponding to the extraction taper of the second portion 6*b*) providing a larger diameter toward the rear side in the axial direction is given to an outer peripheral surface of the second shaft portion 52. An extraction taper (corresponding to the extraction taper of the first portion 6*a*) with a smaller angle than the second shaft portion 52 is given to an outer peripheral surface of the first shaft portion 51, or an extraction taper is not substantially given to the outer peripheral surface of the first shaft portion 51. The mean outer diameter of the first shaft portion 51 corresponds to the mean inner diameter of the first portion 6*a*, and the mean outer diameter of the second shaft portion 52 corresponds to the mean inner diameter of the second portion 6*b* of the through hole 6. The dimension of the press pin 50 may be selected according to the types of insulators to be manufactured. Particularly when a thin insulator is to be manufactured, a press pin having a small diameter of about 2.5 mm to 3.6 mm as the dimension of the second shaft portion 52 can be used.

Since the press pin 50 is a very thin shaft member in this way, for example, the whole press pin is made of a material of high rigidity, for example, cemented carbide, alloy tool steel, etc. so that problems, such as bending, are not caused, for example, in a compression molding step or the like.

Figure 3:
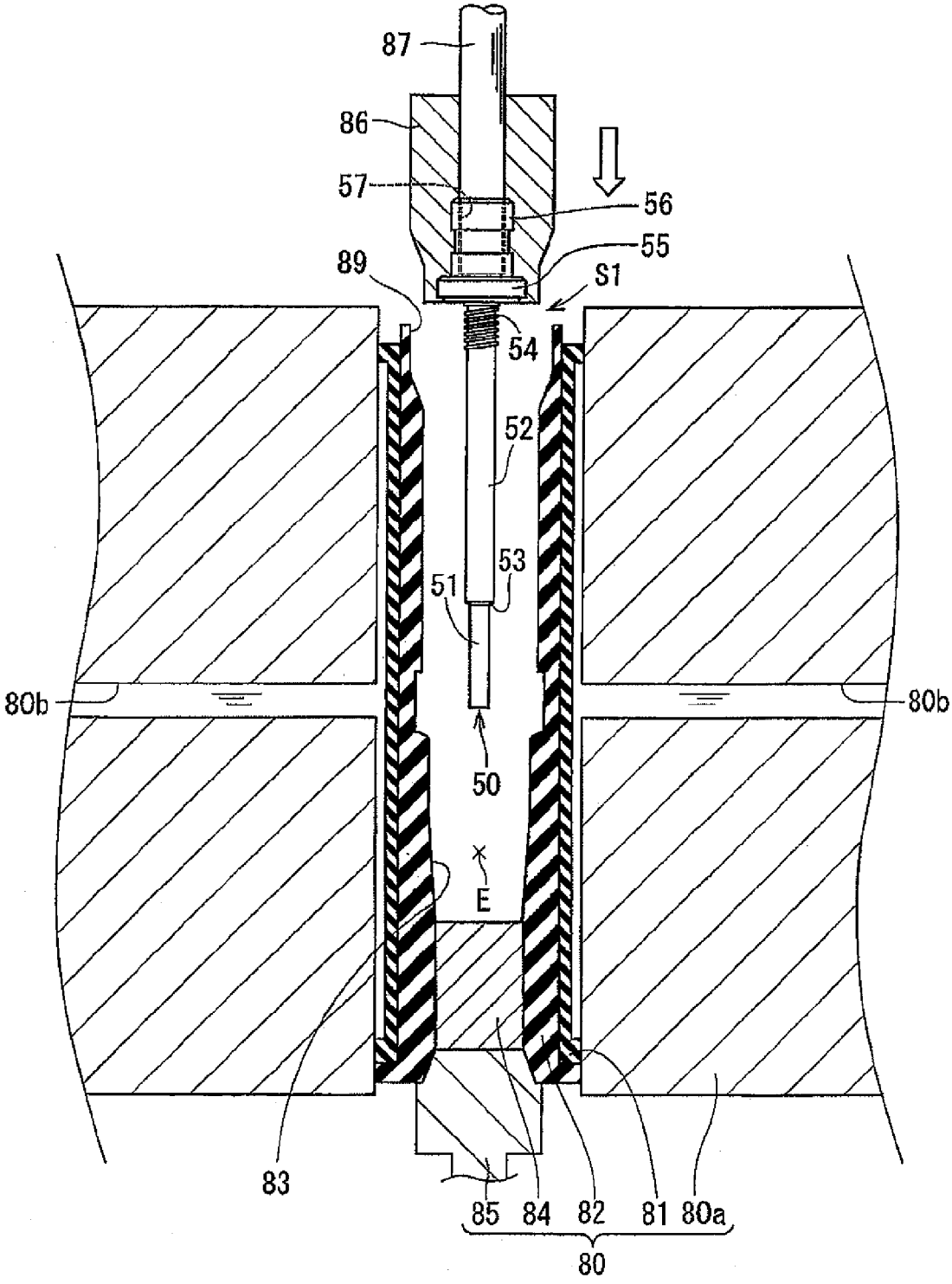
FIG. 3 is an explanatory view showing a manufacturing step in the method the embodiment 1 of the present invention.

A flange-shaped end face forming portion 55 which is used to form a rear end face of a compact PC, which will be described later, is integrally formed at a rear end of the second shaft portion 52 of the press pin 50. A head 56 in which a female threaded portion 57 extends in the axial direction is integrally formed at the rear of the forming portion 55. As shown in FIG. 3, an upper holder portion 86 is rotatably fitted to the outside of the head 56.

As shown in FIG. 2, a rib-like pin-side spiral portion 54 is formed at an outer peripheral surface on the rear end side of the second shaft portion 52. The spiral winding direction of the pin-side spiral portion 54 is reverse to the spiral winding direction of the female threaded portion 57.

The forming die 80, as shown in FIGS. 3 to 6, is configured to perform a forming method generally called "rubber pressing." The "rubber pressing" is a forming method of filling powder, such as a ceramic material, into a rubber die and applying high fluid pressure from an outer periphery of the rubber die, thereby manufacturing a homogeneous compact.

Figure 5:
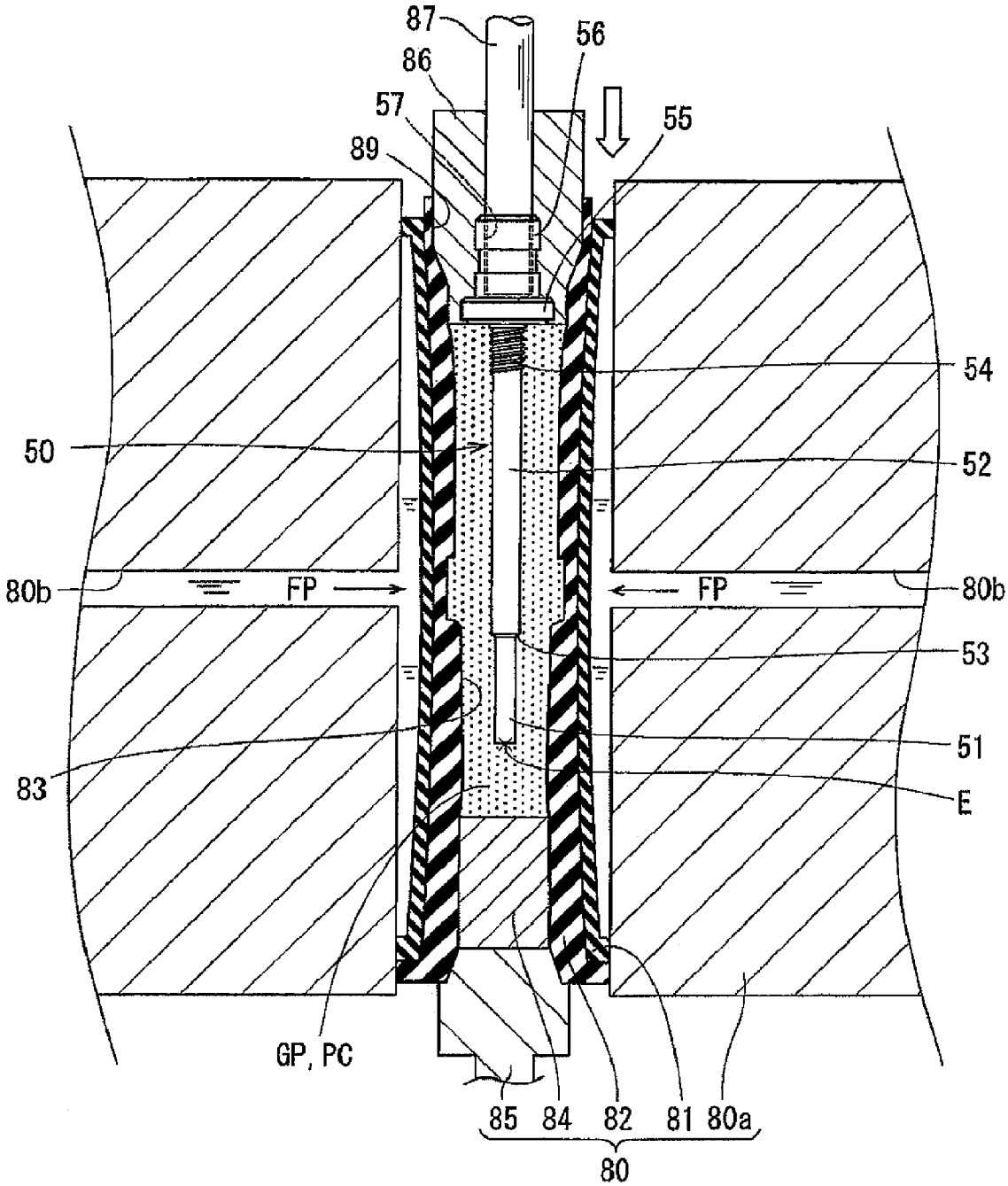
FIG. 5 is an explanatory view showing a manufacturing step in the method of the embodiment 1 of the present invention.

In more detail, the forming die 80 is configured such that a cylindrical inner rubber die 82 is substantially concentrically arranged within a cylindrical outer rubber die 81 arranged within a forming die member 80*a*. The inner rubber die 82 defines a cavity 83 passing therethrough in an axial direction. A lower (the tip side in the axial direction) opening of the cavity 83 is blocked by a bottom lid 84 and a lower holder portion 85. An opening 89 is formed above (the rear end side in the axial direction) the cavity 83. The opening 89, as shown in FIG. 5, is blocked as the rear end of the press pin 50 integrated with the upper holder portion 86 is fitted into the opening 89 in the cavity blocking step which will be described later. This way, the inside of the cavity 83 is brought into a sealed state.

Press Pin Arranging Step

In the press pin arranging step, as shown in FIG. 3, a tip of a rotary shaft 87 is screwed to the female threaded portion 57, and the press pin 50, in a state where the upper holder portion 86 is fitted to the outside of the head 56, is arranged within the cavity 83 by advancing the press pin 50 toward the tip side of the forming die 80 in the axial direction from the opening 89. Here, the position of the press pin 50 within the cavity 83, where the press pin 50 is to be arranged when the compression molding step shown in FIG. 5 is performed, is defined as a "final position." In FIGS. 3 to 6 a position of the tip (tip side axial end) of the press pin 50 in the final position is indicated by E. In the embodiment 1, in the press pin arranging step, advancing of the press pin 50 is stopped before reaching the final position E (for example, a distance between the tip of the press pin 50 and the final position E in the axial direction is about 5 mm to 20 mm), so that a gap S1 is formed between the upper holder portion 86 and the opening 89 of the cavity 83 in the vertical (axial) direction. That is, the tip of the press pin 50 in this state is spaced apart from the final position E to provide the gap S1.

Powder Filling Step

Figure 4:
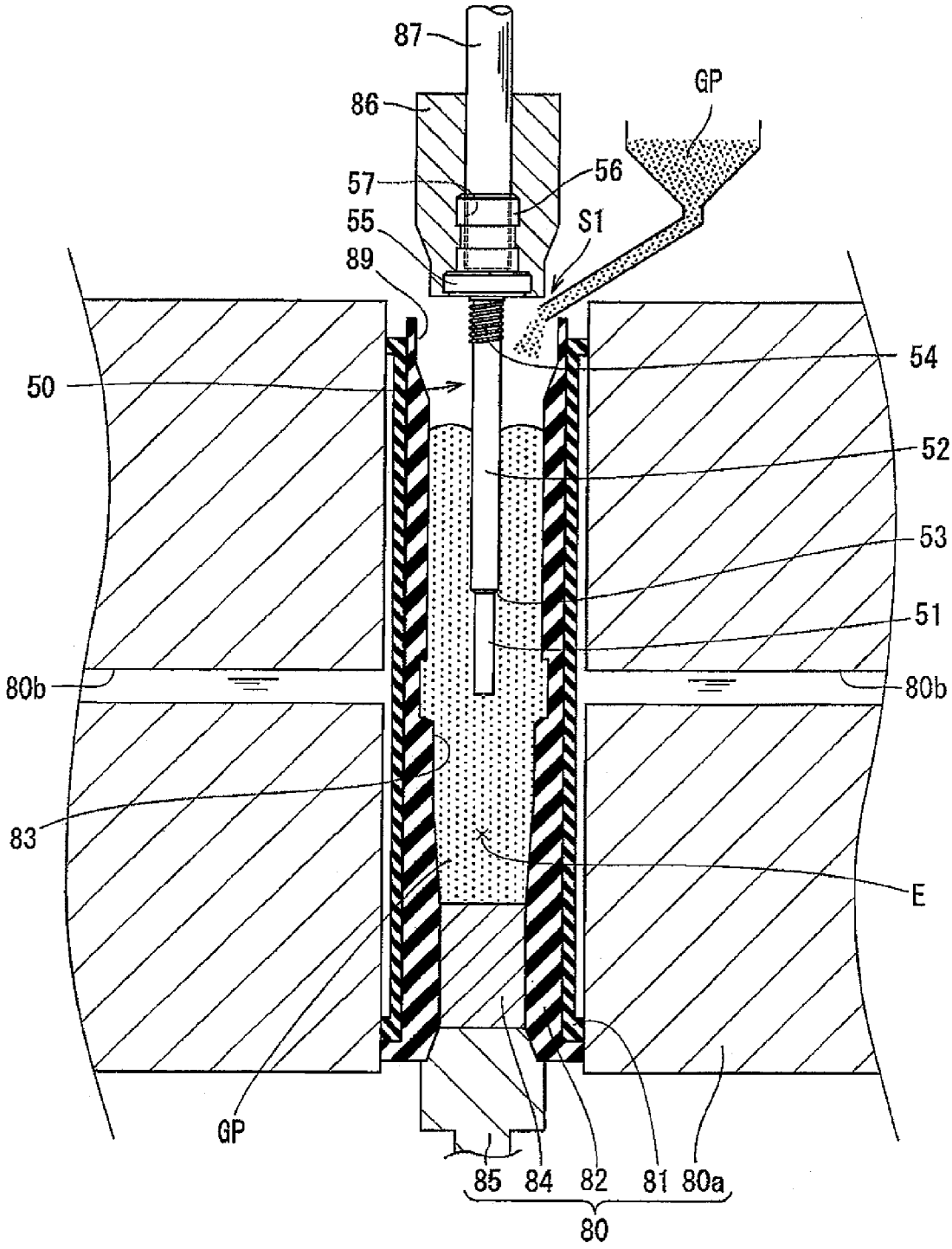
FIG. 4 is an explanatory view showing a manufacturing step in the method of the embodiment 1 of the present invention.

In the powder filling step, as shown in FIG. 4, green powder GP is charged and filled into the cavity 83 through the gap S1 between the upper holder portion 86 and the opening 89 of the cavity 83.

The green powder GP is prepared, for example, as follows. First, a base slurry for forming is made by blending alumina powder (whose mean particle diameter is 1 to 5 μm) with an additive-element-based material, such as an Si component, a Ca component, an Mg component, a Ba component, or a B component which is used as a sintering agent, in a predetermined ratio, and adding and mixing a hydrophilic binder (for example, PVA or an acrylamide-based binder) and water. As for the additive-element-based materials, for example, the Si component can be blended in the form of an $SiO_2$ powder, the Ca component can be blended in the form of a $CaCO_3$ powder, the Mg component can be blended in the form of an MgO powder, the Ba component can be blended in the form of a $BaCO_3$, the B component can be blended in the form of an $H_3BO_3$ powder (or may be an aqueous solution). Further, the green powder GP as a base granulated material for forming is manufactured by spraying and drying the base slurry for forming by a spraying and drying method or the like.

The green powder GP manufactured in this way is adjusted so as to contain moisture within a range of 1.5% or less by weight by adjustment of conditions at the time of spraying and drying (for example, drying temperature, spraying velocity, etc.). Main objects of the moisture blending are to lower the binding force of powder particles in granulated particles to promote cracking of the granulated particles at the time of pressing, and to expand a hydrophilic binder blended with the base material for forming to exhibit a caking property effectively to thereby enhance the strength of the compact PC.

Although the lower limit of the moisture content of the green powder GP differs according to the particle size distribution of the green material GP or the like, the lower limit is suitably set to such a degree that the above effect is not insufficient. If the water content exceeds 1.5% by weight, the fluidity of the granulated material degrades, and handling becomes difficult. More desirably, this water content is adjusted to a range of 1.3% or less by weight.

The blending amount of the hydrophilic binder in the green powder GP is preferably adjusted to 0.5 to 3.0% by weight. If the blending amount of the hydrophilic binder becomes less than 0.5% by weight, the strength of the compact PC becomes insufficient, handling becomes difficult, and cracking, chipping, or the like is apt to occur. If the blending amount exceeds 3.0% by weight, de-binder treatment time at the time of sintering becomes long, which leads to lowering of the manufacturing efficiency of an insulator. In addition to this, the residual volume of impurities components (for example, carbon) derived from a binder in the insulator may increase, which leads to deterioration of performance (for example, dielectric voltage resistance).

As shown in FIG. 4, the green powder GP adjusted in the above state is charged into the cavity 83 from the gap S1 between the upper holder portion 86 and the opening 89 of the cavity 83 to be deposited upward from a lower portion of the cavity 83. This way, the green powder GP is filled into the cavity 83 around the press pin 50 arranged within the cavity 83. After a predetermined amount of green powder GP is filled into the cavity 83, the next step is performed.

Cavity Blocking Step

In the cavity blocking step, as shown in FIG. 5, the press pin 50 stopped short of the final position E within the cavity 83 is inserted to reach the final position E. Concurrently, the opening 89 is blocked as the rear end of the press pin 50 integrated with the upper holder portion 86 is fitted into the opening 89. This way, the inside of the cavity 83 is brought into a sealed state. Here, since the green powder GP is adjusted such that the moisture content thereof is within a predetermined range as described above, the green powder is not in a dried loose state. For this reason, when the press pin 50 is moved toward the tip side of the die 80 in the axial direction within the green powder GP, the press pin 50 receives a resistance having a certain degree of magnitude from the green powder GP. However, in the embodiment 1, the insertion distance of the press pin 50 during the cavity blocking step is a very short distance, i.e. a distance from the tip of the press pin 50 stopped during the powder filling step to the final position E, substantially corresponding to the gap S1. For this reason, the resistance that the press pin 50 receives from the green powder GP during the cavity blocking step can be made significantly small. Here, the upper holder portion 86 can serve as a blocking member for blocking the opening 89.

Compression Molding Step

In the compression molding step, as shown in FIG. 5, the green powder OP within the cavity 83 is pressed along with the press pin 50 to obtain the compact PC.

In more detail, fluid pressure FP is applied to the outer peripheral surface of the outer rubber die 81 in the radial direction via a pressurized liquid passage 80*b* formed in the forming die body 80*a*, so that the outer rubber die 81 and the inner rubber die 82 elastically deform to reduce their diameters and the volume of the cavity 83. Accordingly, the fluid pressure FP is indirectly applied to the green powder GP via the outer rubber die 81 and the inner rubber die 82 to compress the green powder GP filled into the cavity 83. As a result, the green material GP of the cavity 83 is solidified in such a form that the press pin 50 is integrated therewith, and the compact PC is obtained.

In this case, the fluid pressure FP is preferably adjusted in a range of 30 to 150 MPa. If the fluid pressure FP becomes less than 30 MPa, the strength of the compact PC becomes insufficient, handling becomes difficult, and cracking, chipping, or the like, is apt to occur. If the fluid pressure exceeds 150 MPa, the lifespan of the outer rubber die 81 and the inner rubber die 82 may become short, which may lead to an increase in cost.

Die Releasing Step

Figure 6:
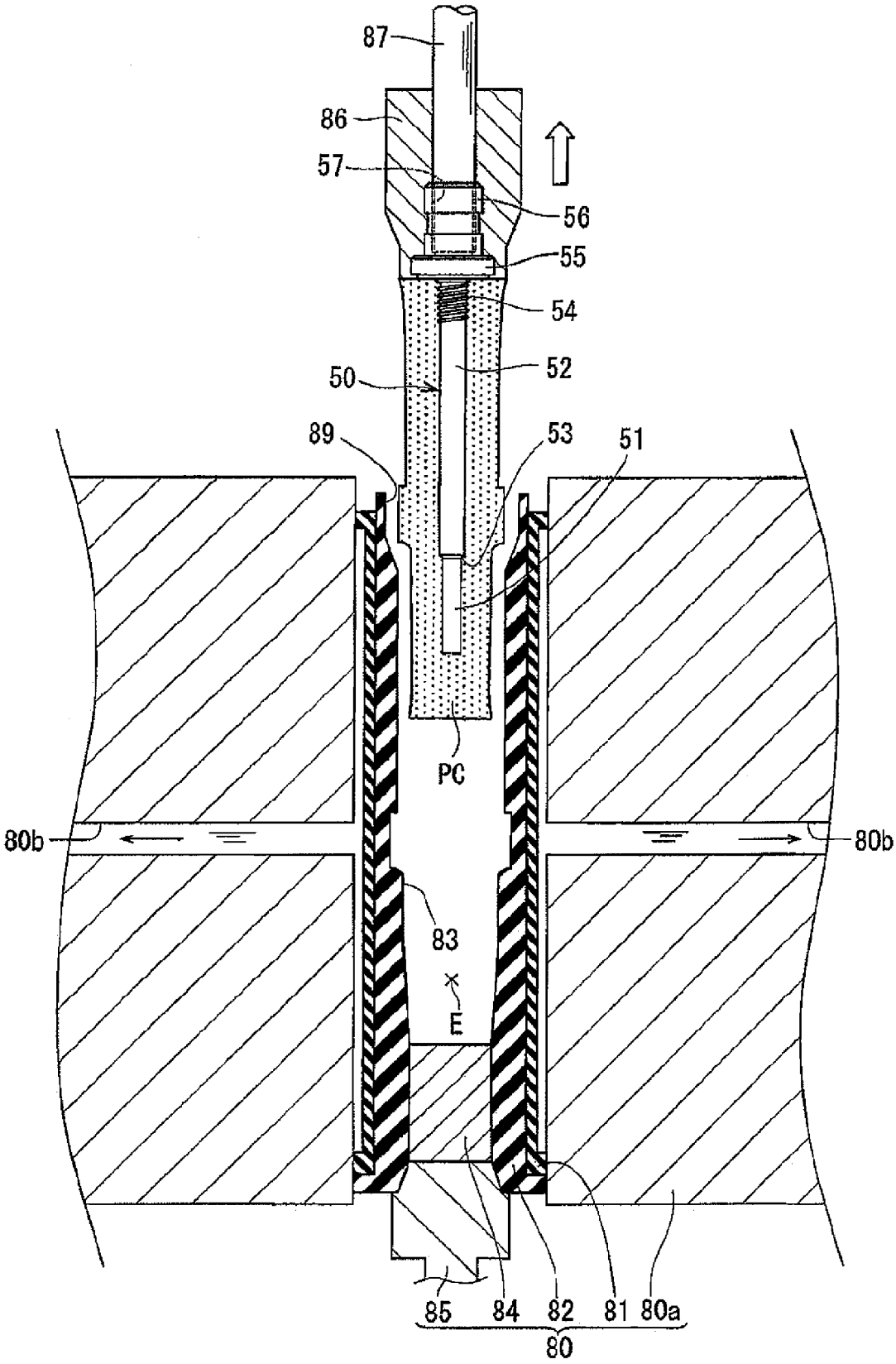
FIG. 6 is an explanatory view showing a manufacturing step in the method of the embodiment 1 of the present invention.

In the die releasing step, as shown in FIG. 6, the compact PC along with the press pin 50 is released from the cavity 83. In more detail, when application of the fluid pressure FP is released, the outer rubber die 81 and the inner rubber die 82 is elastically restored to their original shapes, and therefore the cavity 83 is also returned to its original shape. Accordingly, an outer peripheral surface of the compact PC is released from an inner peripheral surface of the cavity 83 (the inner rubber die 82) to provide a space therebetween. By pulling up the press pin 50 integrated with the rotary shaft 87 and the upper holder portion 86 toward the rear end side of the die 80 in the axial direction relative to the outer rubber die 81 and the inner rubber die 82, the press pin 50 having the compact PC stuck thereon is pulled out of the cavity 83.

Press Pin Removing Step

Figure 7:
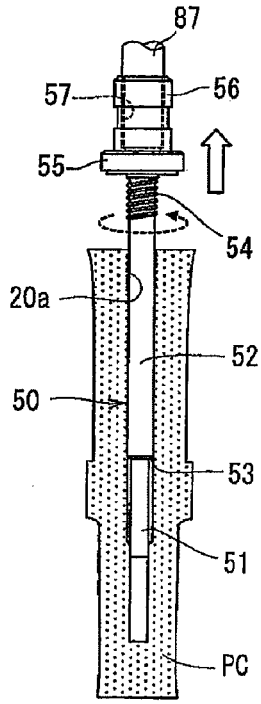
FIG. 7 is an explanatory view showing a manufacturing step in the method of the embodiment 1 of the present invention.

In the press pin removing step, as shown in FIG. 7, the press pin 50 is pulled out of the compact PC. In more detail, when the compact PC is obtained using the press pin 50 having the pin-side spiral portion 54, the compact PC is correspondingly formed with a compact-side spiral portion 20*a*. The compact-side spiral portion 20*a* has a shape reverse to the pin-side spiral portion 54 (that is, a groove shape) and is located at a rear end of an inner tubular surface of the compact PC which faces the second shaft portion 52 of the press pin 50. In addition, the compact-side spiral portion 20*a* is often removed by cutting or the like. However, if the compact-side spiral portion 20*a* is not removed, as shown in FIG. 1, the compact-side spiral portion 20*a* remains as a spiral portion 20 in the insulator 2 after sintering.

As shown in FIG. 7, in a state in which the compact PC pulled up from the cavity 83 is held by an air chuck (not shown), the rotary shaft 87 threaded into the female thread hole 57 of the press pin 50 is rotated in a direction in which the rotary shaft 87 is fastened into the female thread hole 57 by a driving source, such as a motor (not shown). Accordingly, the press pin 50 is rotated around an axis relative to the compact PC, and thus unfastened from the compact PC by way of threading action between the pin-side spiral portion 54 and the compact-side spiral portion 20*a*. Accordingly, the press pin 50 moves up in the extraction direction, while rotating.

That is, since the press pin 50 moves up slowly, while rotating by way of the threading action, generation of an excessive frictional force is prevented between the outer peripheral surface of the press pin 50 and the opposing, inner tubular surface of the compact PC. Therefore, the press pin 50 can be extracted smoothly without damaging the compact PC. Moreover, since an extraction taper is given to the second shaft portion 52 of the press pin 50, a gap from the inner tubular surface of the compact PC can be secured when the press pin 50 is moved slightly upward relative to the compact PC. Therefore, the press pin 50 can be easily released. In addition, a die-releasing layer, such as a hard-carbon-based die releasing layer, may be formed on the outer peripheral surface of the press pin 50 to further facilitate extraction of the press pin 50.

Figure 8:
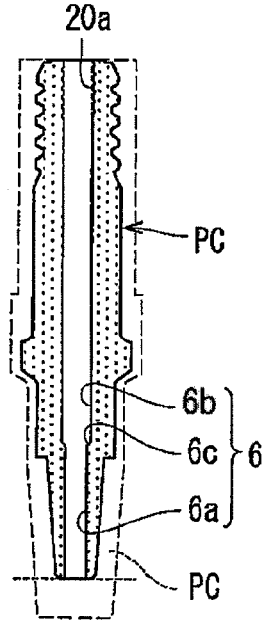
FIG. 8 is an explanatory view showing a manufacturing step in the method of the embodiment 1 of the present invention.

The outer surface of the compact PC which has completed the above respective steps and from which the press pin 50 has been extracted, is machined by grinder or the like to be finished into an external shape corresponding to the insulator 2 as shown in FIG. 8, and is then sintered at a temperature of 1400 to 1650° C. Accordingly, the inner tubular surface of the compact PC which has faced the outer peripheral surface of the press pin 50 becomes the through hole 6. Then, the glaze is further applied to the compact, and the compact is finish-sintered by applying glaze thereto, whereby the insulator 2 shown in FIG. 1 is completed. The insulator 2 obtained in this way is assembled into other constituent members such as the metal shell 1, whereby the spark plug 100 is completed. The spark plug 100 is attached to an engine with the threaded portion 7, and is used as an igniting source for an air-fuel mixture supplied to a combustion chamber.

As described above, in the method for manufacturing an insulator for a spark plug according to the embodiment 1, the press pin arranging step is carried out before the powder filling step so that the press pin 50 is arranged within the cavity 83 while the gap S1 is secured. Next, in the powder filling step, the green powder GP is charged into the cavity 83 from the gap S1 to be filled into the cavity 83 around the press pin 50 arranged within the cavity 83. In the subsequent cavity blocking step, the distance by which the press pin 50 is inserted to the final position E becomes a very short distance substantially corresponding to gap S1. Accordingly, during the cavity blocking step, the resistance that the press pin 50 receives from the green powder GP can be made significantly small. For this reason, bending of the press pin 50 is prevented, and the inner tubular surface of the compact PC, which faces the outer peripheral surface of the press pin 50, can be formed to extend straight in the axial direction. Consequently, the through hole 6 of the insulator 2 also extends straight in the axial direction.

According to the manufacturing method of the embodiment 1, generation of inferior articles can be reduced, and replacement frequency of the press pin 50 can be reduced when the insulator 2 having a small diameter is manufactured. That is, this manufacturing method can guarantee high yield about the insulator 2, and can realize low manufacturing cost of the spark plug 100.

According to the manufacturing method of the embodiment 1, the upper holder portion 86, serving as a blocking member, and the press pin 50 are integral. In the press pin arranging step, the press pin 50 is stopped short of the final position E to secure such a gap S1 between the upper holder portion 86 and the opening 89 that is enough to supply the green powder GP into the cavity 83. The green powder GP is supplied and filled into the cavity 83 from the gap S1. Moreover, when the press pin 50 is moved to the final position E in the cavity blocking step, the upper holder portion 86 also moves integrally with the press pin 50 to block the opening 89. This manufacturing method having such a simple configuration can easily provide the operational effects.

Embodiment 2

Although the manufacturing method of an embodiment 2 is similar to the embodiment 1, a press pin 250 and an upper holder portion 286 are used instead of the press pin 50 and the upper holder portion 86 of the embodiment 1. For this reason, the above-mentioned respective steps also have points of difference due to differences of the configuration of these members. Hereinafter, differences from those of the manufacturing method of the embodiment 1 will be described in an emphasized manner, and the description of the same steps as the steps of the embodiment 1 will be omitted or simplified. The same configurations as those of the embodiment 1 are denoted by the same reference numerals, and the description thereof is omitted.

Hereinafter, the method for manufacturing an insulator 2 according to the embodiment 2 will be described referring to FIGS. 9 to 13.

Preparing Step

Figure 9:
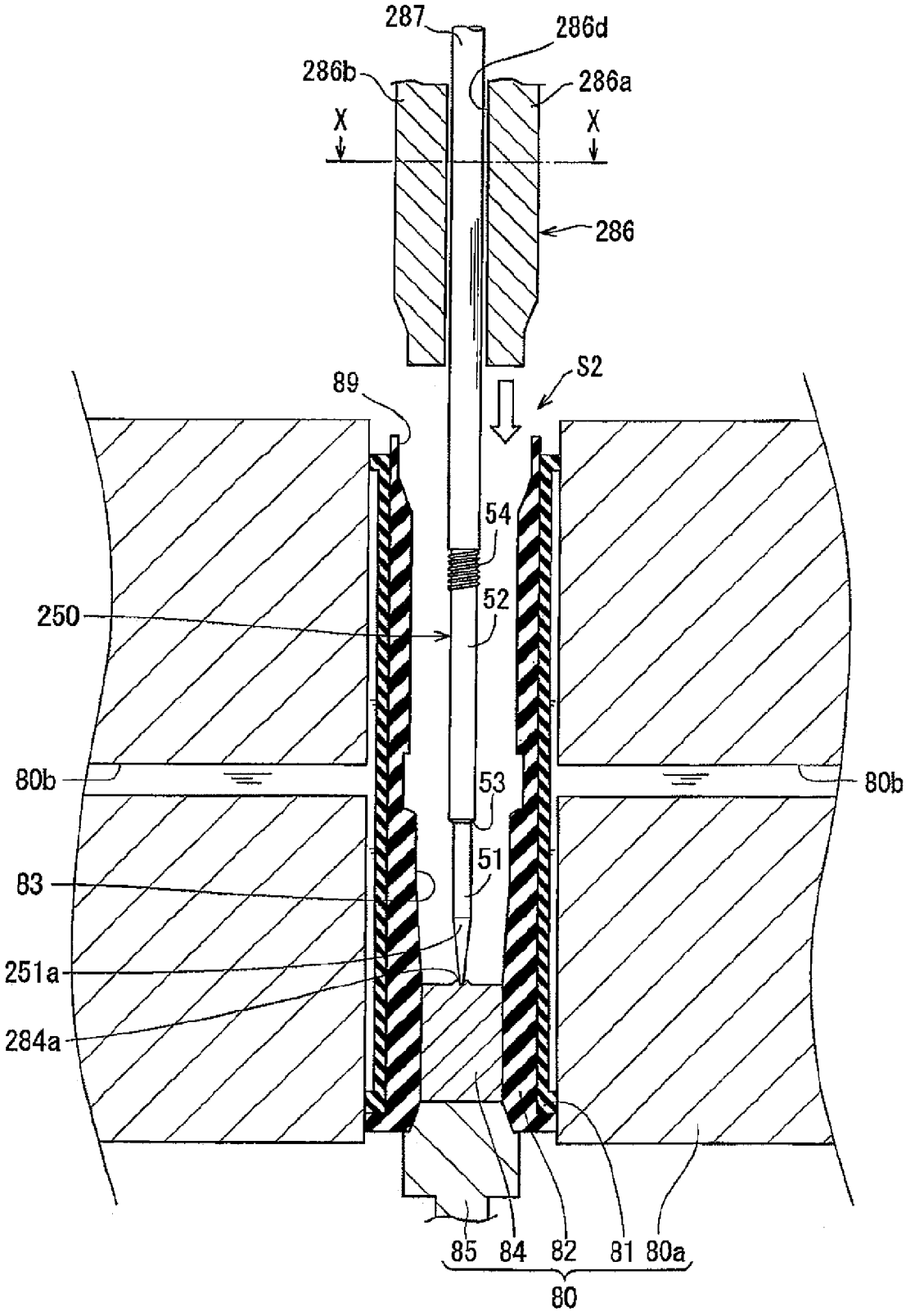
FIG. 9 is an explanatory view showing a manufacturing step in a method for manufacturing an insulator for a spark plug according to an embodiment 2 of the present invention.

In a preparing step, as shown in FIG. 9, the press pin 250 and the forming die 80 are prepared. Since the forming die 80 is the same as that of the embodiment 1, the description thereof is omitted.

Similar to the press pin 50 of the embodiment 1, the press pin 250 is formed with the first shaft portion 51, the stepped portion 53, the second shaft portion 52, and the pin-side spiral portion 54. The press pin 250 is not formed with the end face forming portion 55 and head 56 in the press pin 50 of the embodiment 1. Instead, the press pin 250 is integrally formed with a columnar rotary shaft portion 287 which extends from the rear end of the second shaft portion 52 toward the rear side in the axial direction. The rotary shaft portion 287 corresponds to the rotary shaft 87 of the embodiment 1, and is adapted to rotate by a driving source, such as a motor (not shown).

Figure 10A:
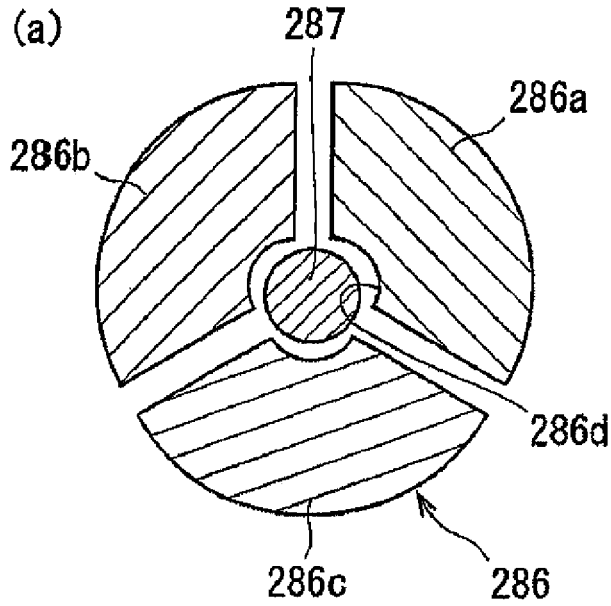
FIGS. 10A and 10B are sectional views showing an X-X section of FIG. 9.
Figure 10B:
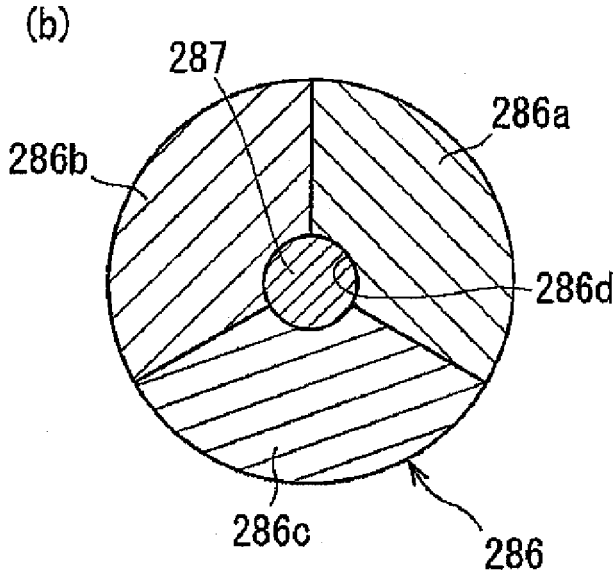

As shown in FIG. 9 or the like, the upper holder portion 286 is disposed around the outer peripheral surface of the rotary shaft portion 287. As shown in FIG. 10A and FIG. 10B, the upper holder portion 286 is constituted by three split members 286*a*, 286*b*, and 286*c*, each having a sector-like cross-section. These split members 286*a*, 286*b* and 286*c* are arranged to surround the outer peripheral surface of the rotary shaft portion 287. The center space surrounded by the split bodies 286*a*, 286*b*, and 286*c* serves as an insertion hole 286*d*, through which the rotary shaft portion 287 can be inserted.

As shown in FIG. 10A, when the split members 286*a*, 286*b*, and 286*c* are separated radially outward from the rotary shaft portion 287, the diameter of the insertion hole 286*d* is increased. In this state, the rotary shaft portion 287 passing through the insertion hole 286*d* is movable relative to the upper holder portion 286 in the axial direction.

As shown in FIG. 10B, when the split members 286*a*, 286*b*, and 286*c* approach the rotary shaft portion 287, the insertion hole 286*d* is brought into close contact with the rotary shaft portion 287, and the split members 286*a*, 286*b*, and 286*c* are integrally combined to constitute an annular member. The split members 286*a*, 286*b*, and 286*c* in this state can block the opening 89 in a cavity blocking step which will be described later, thereby sealing the inside of the cavity 83.

As shown in FIG. 9, the press pin 250 is formed with a protruding portion 251*a* which protrudes in a substantially conical shape from the first shaft portion 51 toward the tip in the axial direction. A recess 284*a* is formed in the center of an upper face of the bottom lid 84 to correspond to the protruding portion 251*a*. The tip of the protruding portion 251*a* can fit into the recess 284*a*.

Press Pin Arranging Step

In the press pin arranging step, the press pin 250 and the upper holder portion 286 are first arranged above the opening 89 of the forming die 80. Then, the split members 286*a*, 286*b*, and 286*c* of the upper holder portion 286 are separated radially outward from the rotary shaft portion 287 to increase the diameter of the insertion hole 286*d*. In this case, a gap S2 in the vertical direction is formed between the upper holder portion 286 and the opening 89. In the embodiment 2, since the press pin 250 and the upper holder portion 286 are relatively movable in the axial direction independently of each other, it is possible to form a larger gap S2 than the gap S1 in the embodiment 1.

Figure 11:
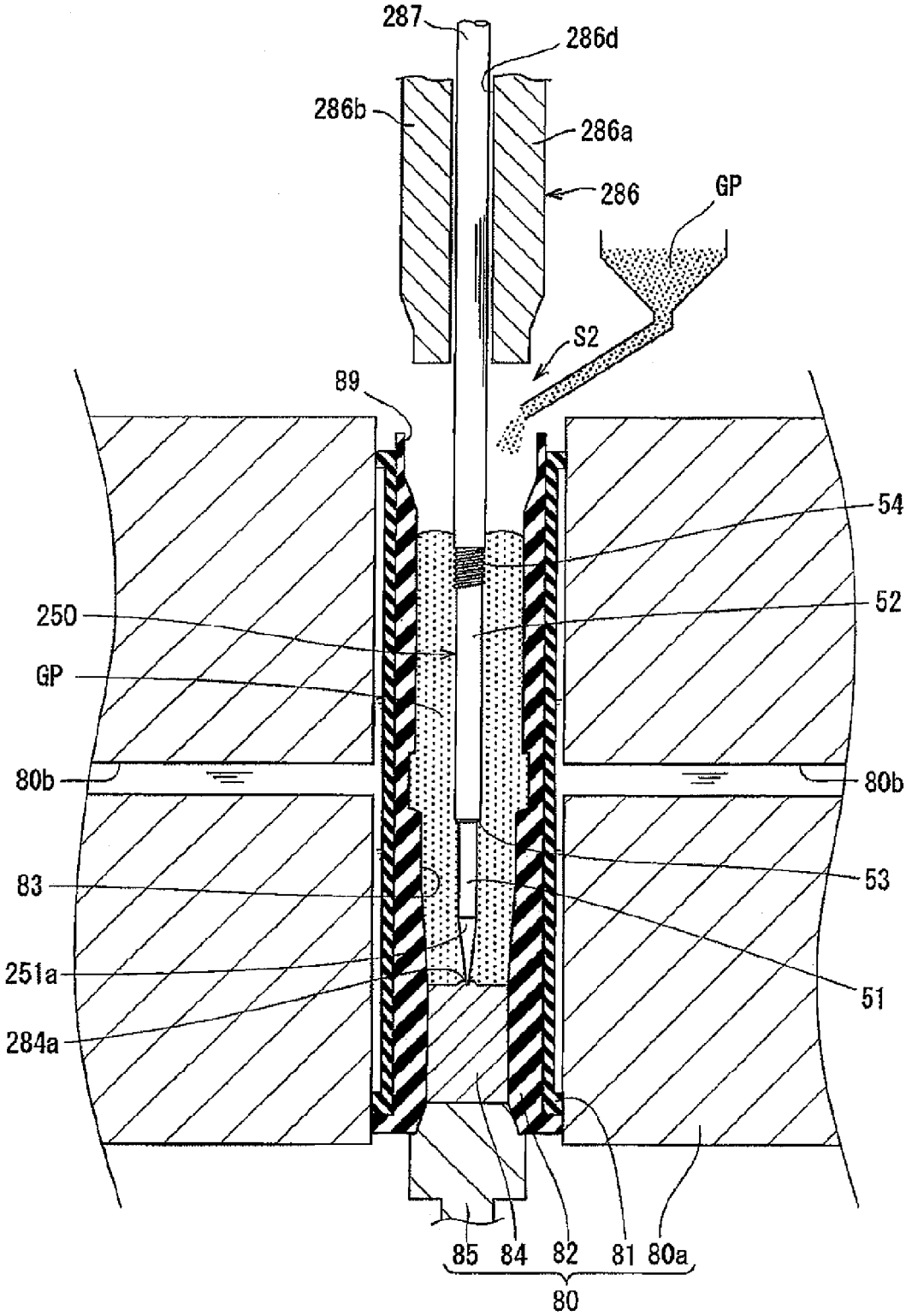
FIG. 11 is an explanatory view showing a manufacturing step in the method of the embodiment 2 of the present invention.
Figure 12:
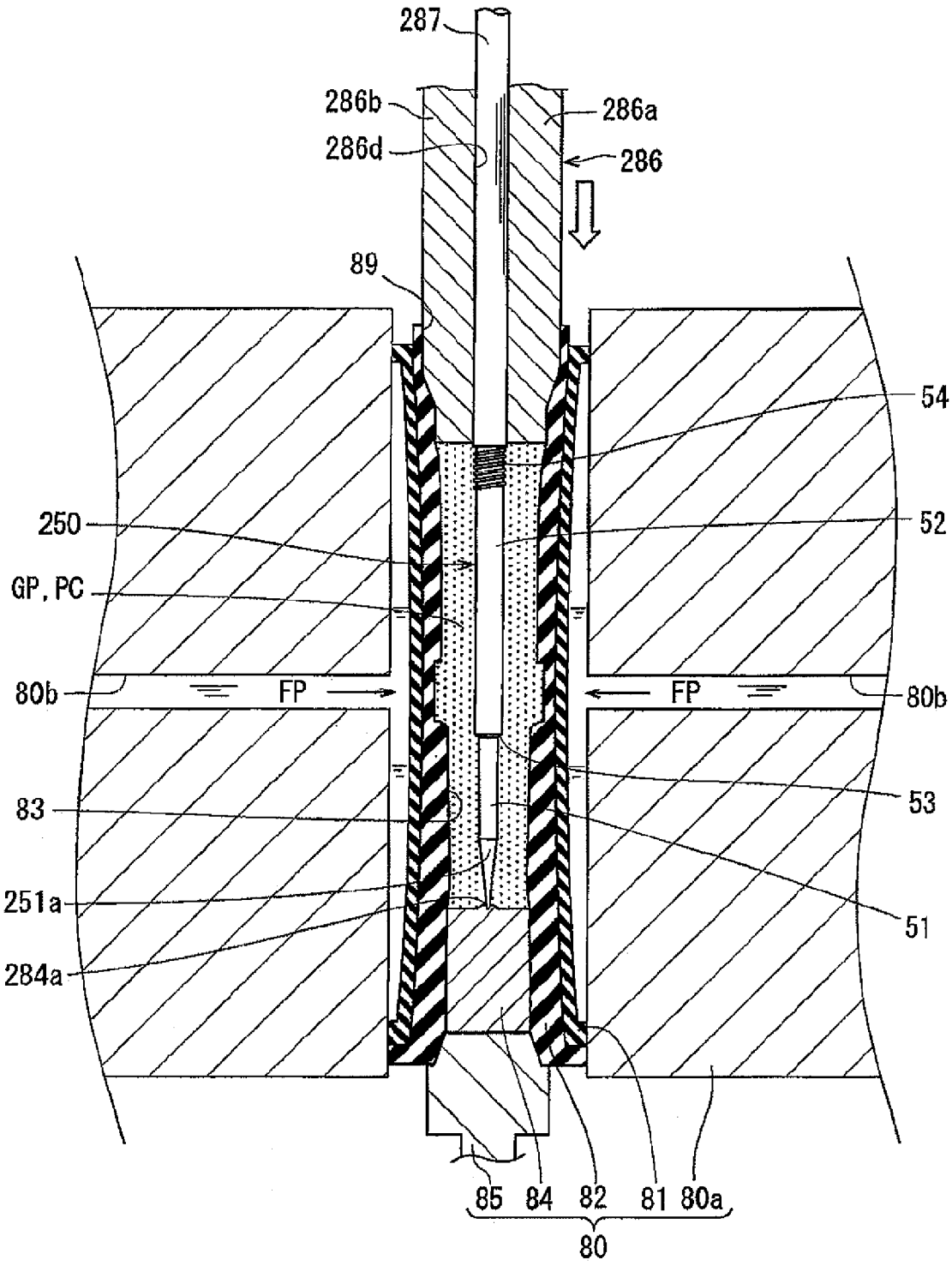
FIG. 12 is an explanatory view showing a manufacturing step in the method of the embodiment 2 of the present invention.

Next, the rotary shaft portion 287 is moved relative to the insertion hole 286*d* toward the tip in the axial direction so that the press pin 250 is inserted into the cavity 83 from the opening 89 until the press pin 250 reaches the final position on the tip side in the axial direction. The position of the press pin 250 within the cavity 83 when the compression molding step shown in FIG. 12 is performed is defined as a "final position." As shown in FIGS. 9 and 11, in the embodiment 2, unlike embodiment 1, the press pin 250 is arranged at the final position in the press pin arranging step. When the press pin 250 is arranged at the final position, the tip of the protruding portion 251*a* fits into the recess 284*a* of the bottom lid 84. Accordingly, the press pin 250 is restrained, and displacement in a direction (radial direction) perpendicular to the axis is prevented. The recess 284*a* serves as a positioning portion for positioning the radial position of the tip of the press pin 250.

Powder Filling Step

In the powder filling step, as shown in FIG. 11, green powder GP is charged and filled into the cavity 83 from the gap S2 between the upper holder portion 286 and the opening 89 of the cavity 83 around the press pin 250.

Cavity Blocking Step

In the cavity blocking step, as shown in FIG. 11, the upper holder portion 286, in a state where the diameter of the insertion hole 286*d* has been increased as shown in FIG. 10A, is moved toward the tip in the axial direction to block the opening 89 as shown in FIG. 12. In linking with the movement of the upper holder portion 286, to fit the tip of the upper holder portion 286 into the opening 89 of the cavity 83, the diameter of the insertion hole 286*d* is gradually decreased and the split members 286*a*, 286*b*, and 286*c* are finally brought into close contact with each other to constitute one annular body as shown in FIG. 101B. Consequently, the inside of the cavity 83 is reliably sealed. Here, unlike the cavity blocking step of the embodiment 1, the press pin 250 does not move in the cavity blocking step of the embodiment 2. Thus, the press pin 250 does not receive any resistance from the green powder GP. The upper holder portion 286 serves as the blocking member for blocking the opening 89.

Compression Molding Step

In the compression molding step, as shown in FIG. 12, the green powder GP within the cavity 83 is pressed along with the press pin 250 to obtain the compact PC. Since the details of the compression molding step are the same as those of the embodiment 1, the description thereof is omitted.

Die Releasing Step

In the die releasing step, application of the fluid pressure FP is released in a state shown in FIG. 12, so that the shrunk cavity 83 is returned to its original shape, and an outer peripheral surface of the compact PC is released from an inner peripheral surface of the cavity 286*c*. Also, the press pin 250 in the state where the split members 286*a*, 286*b*, and 286*c* of the upper holder portion 286 closely contact with each other is pulled up in the axial direction together with the press pin 250 relative to the outer rubber die 81 and the inner rubber die 82. Accordingly, the press pin 250 having the compact PC thereon is pulled out of the cavity 83.

Press Pin Removing Step

Figure 13:
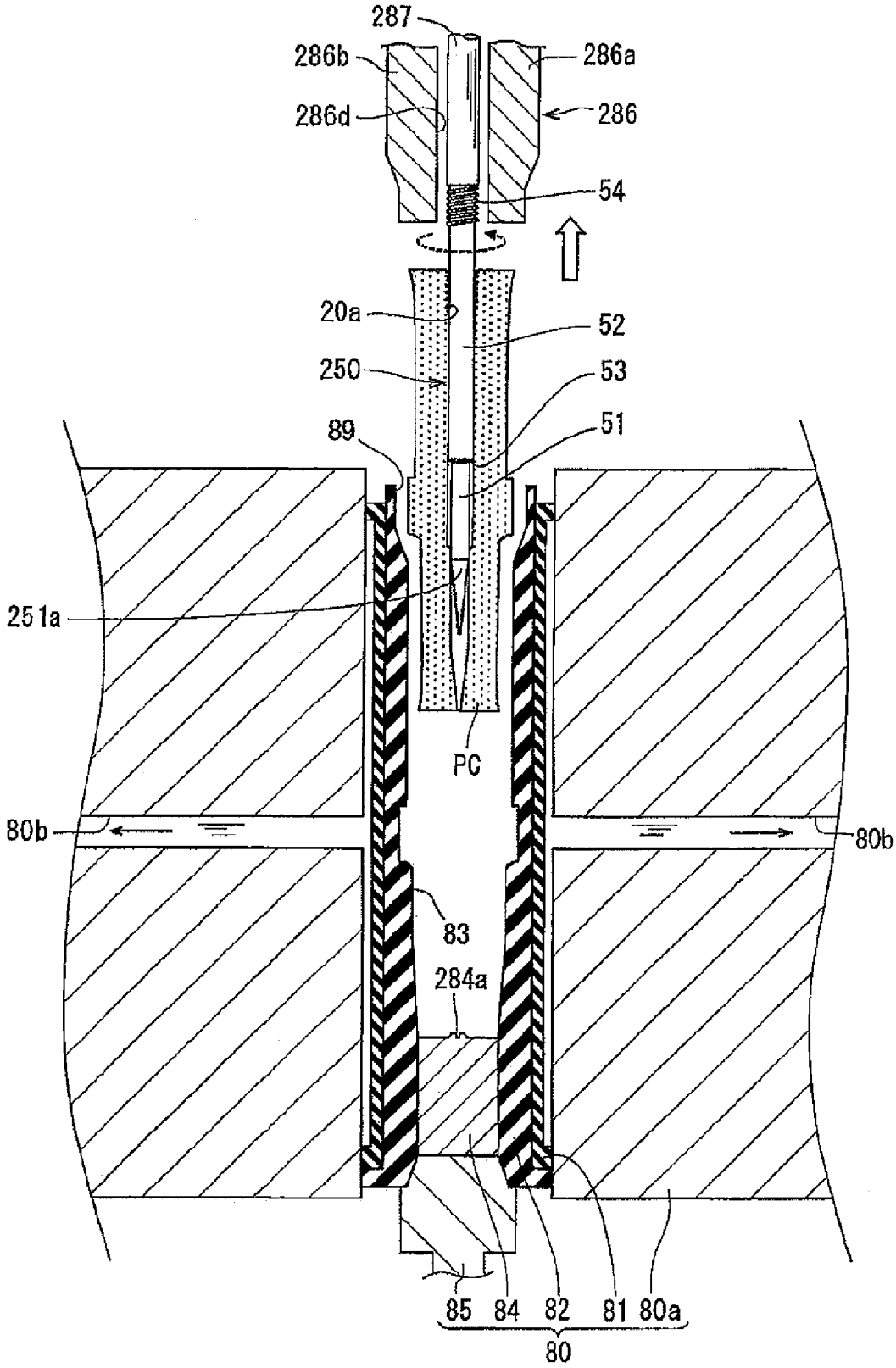
FIG. 13 is an explanatory view showing a manufacturing step in the method of the embodiment 2 of the present invention.

In the press pin removing step, as shown in FIG. 13, the press pin 250 is pulled out of the compact PC. In more detail, as shown in FIG. 10A, the split members 286*a*, 286*b*, and 286*c* of the upper holder portion 286 are separated radially outward from the rotary shaft portion 287 to increase the diameter of the insertion hole 286*d*. As shown in FIG. 13, in the state where the compact PC pulled up from the cavity 83 is held by an air chuck (not shown), the rotary shaft 287 of the press pin 250 is rotated counterclockwise by a driving source, such as a motor (not shown). Accordingly, the press pin 250 rotates around an axis relative to the compact PC, and as described above, the press pin 250 is pulled out of the compact PC by way of the threading action between the pin-side spiral portion 54 and the compact-side spiral portion 20*a*. Since the pin-side spiral portion 54 of the press pin 250 can move without any difficulty within the insertion hole 286*d* having the increased diameter, the size of a manufacturing apparatus of the insulator 2 can be reduced.

The compact PC which has completed the above respective steps and from which the press pin 250 has been extracted, similar to the embodiment 1, is cut and sintered into the insulator 2, and is assembled to the spark plug 100.

According to the method of the embodiment 2, the press pin 250 can be moved within the insertion hole 286*d* by increasing the diameter of the insertion hole 286*d* of the upper holder portion 286 serving as a blocking member. That is, the press pin 250 and the upper holder portion 286 can be moved independently from each other. Therefore, in this manufacturing method, as described above, the gap S2 can be easily secured between the upper holder portion 286 and the opening 89 even when the press pin 250 is moved to the final position within the cavity 83 in the press pin arranging step followed by the powder filling step.

According to this manufacturing method, in the powder filling step, the green powder GP is charged into the cavity 83 from the gap S2 to be filled into the cavity 83 around the press pin 250 arranged in the final position within the cavity 83. In the cavity blocking step, the upper holder portion 286 is moved independently from the press pin 250 to block the opening 89. Accordingly, in the cavity blocking step, the press pin 250 does not move, and does not receive any resistance from the green powder GP. That is, bending of the press pin 250 is prevented.

Accordingly, the manufacturing method of the embodiment 2 can also exhibit the same operational effects as the manufacturing method of the embodiment 1 more reliably than the manufacturing method of the embodiment 1.

Additionally, in this manufacturing method, the tip of the press pin 250 is restrained within the cavity 83 by the recess 284*a* as a positioning portion formed at the bottom lid 84 of the forming die 80. Even if the compressive force in a direction perpendicular to the axis acts on the press pin 250 when the cavity 83 shrinks in the compression molding step, displacement of the radial position of the tip of the press pin 250 is prevented. That is, bending of the press pin 250 is prevented.

Embodiment 3

Figure 14:
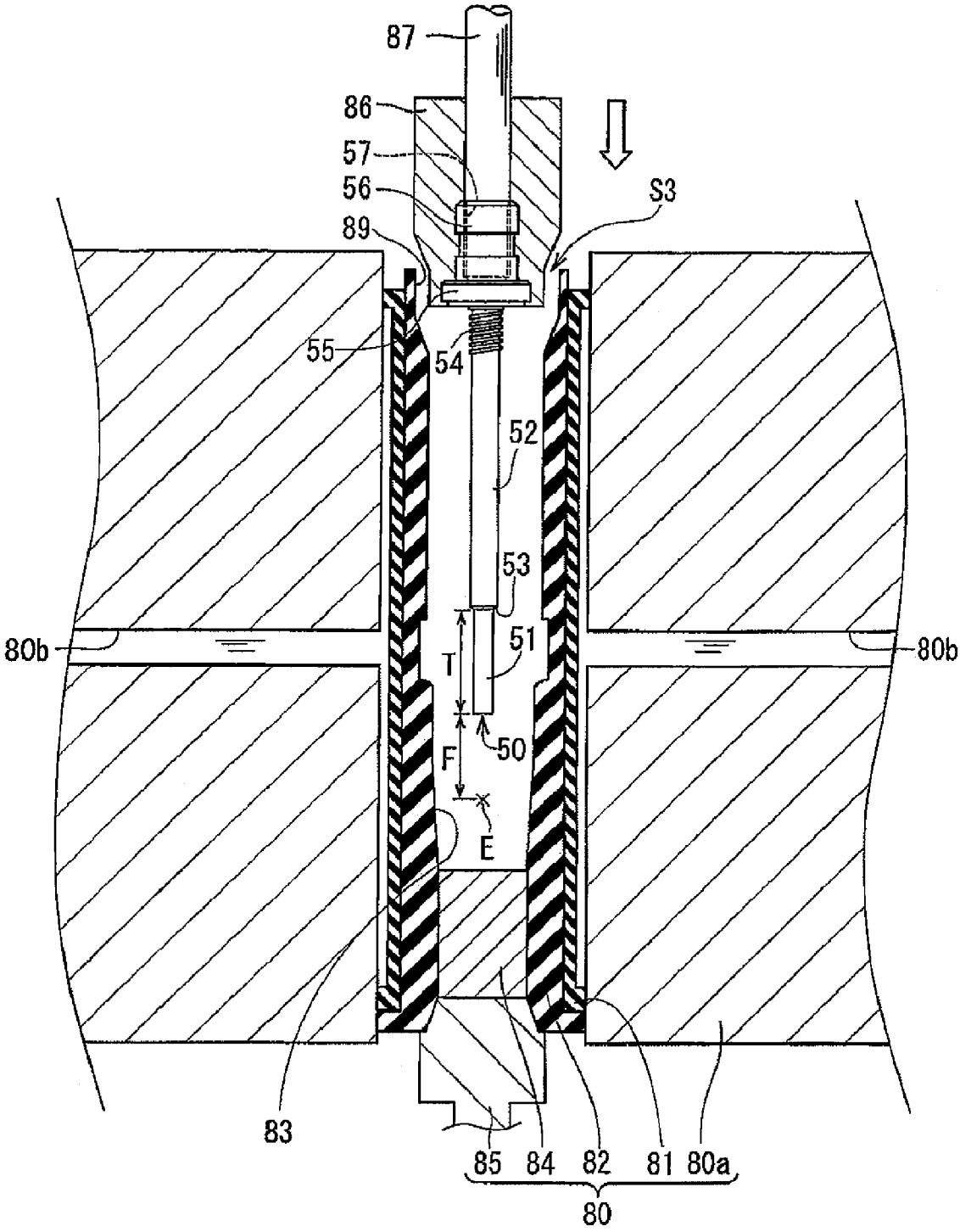
FIG. 14 is a front view of a press pin used in the method for manufacturing an insulator for a spark plug according to an embodiment 3 of the present invention.
Figure 15:
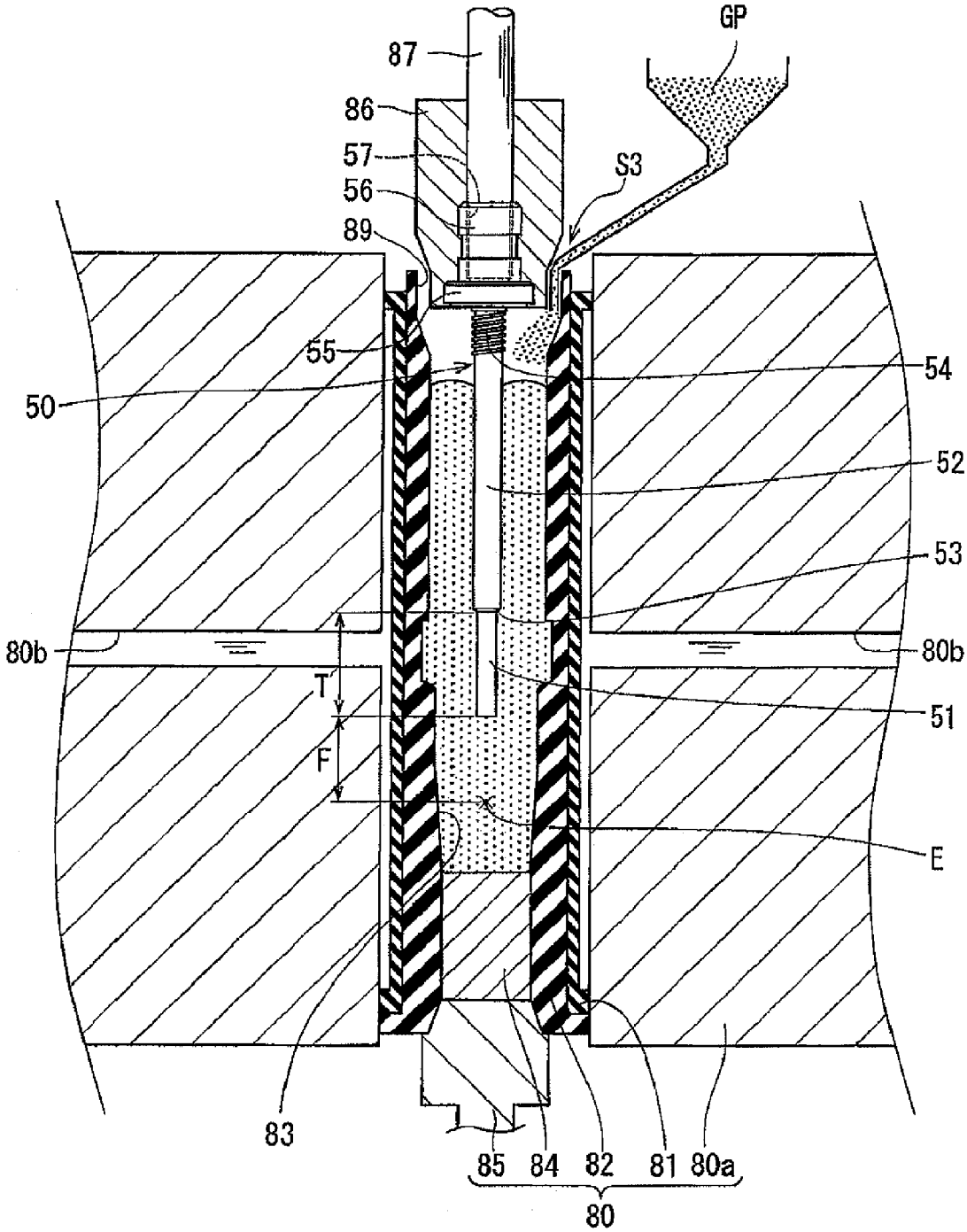
FIG. 15 is an explanatory view showing a manufacturing step in the method of the embodiment 3 of the present invention.

Although the manufacturing method of the embodiment 3 is similarly to Embodiment 1, the press pin arranging step (shown in FIG. 3), and the powder filling step (shown in FIG. 4) of the embodiment 1 are modified as shown FIGS. 14 and 15. Hereinafter, differences from those of the manufacturing method of the embodiment 1 will be described in an emphasized manner, and the description of the same steps as the steps of the embodiment 1 will be omitted or simplified. Additionally, the same configurations as those of the embodiment 1 are also denoted by the same reference numerals, and the description thereof is omitted.

Preparing Step

In a preparing step, similar to the embodiment 1, the press pin 50 and the forming die 80 are prepared. As described in the preparing step of the embodiment 1, the press pin 50 has the first shaft portion 51 on the tip side in the axial direction, the second shaft portion 52 nearer the rear end side in the axial direction than the first shaft portion 51 and having a larger diameter than the first shaft portion 51, and the stepped portion 53 between the first shaft portion 51 and the second shaft portion 52. As shown in FIG. 2, the stepped portion 53 is formed in such a tapered shape so as to connect the first shaft portion 51 and the second shaft portion 52 which differ in external diameter.

Press Pin Arranging Step

In the press pin arranging step, as shown in FIG. 14, the tip of the rotary shaft 87 is screwed to the female threaded portion 57 of the press pin 50, and the upper holder portion 86 is fitted to the outside of the head 56 of the press pin 50. The press pin 50 in this state is arranged within the cavity 83 by advancing the press pin 50 toward the tip in the axial direction from the opening 89. Here, similar to the embodiment 1, the position of the press pin 50 arranged within the cavity 83 when the compression molding step shown in FIG. 5 is performed is defined as a "final position." In FIGS. 14 and 15, the position of the tip of the press pin 50 in the final position is represented as E. In the embodiment 3, in the press pin arranging step, the press pin 50 is stopped at a position axially away from the final position E by a stroke F that is shorter than an axial length T of the first shaft portion 51. Accordingly, a gap S3 is formed between the tip end of the upper holder portion 86 and the opening 89 of the cavity 83 in the radial direction orthogonal to the vertical (axial) direction. That is, in this state, the tip of the press pin 50 is lifted up by the stroke F from the final position E and the tip end of the upper holder portion 86 is lower than the opening 89 of the cavity 83 in the vertical direction.

Powder Filling Step

In the powder filling step, as shown in FIG. 15, green powder GP is loaded and filled into the cavity 83 from the gap S3 between the upper holder portion 86 and the opening 89 of the cavity 83 around the press pin 50 arranged within the cavity 83.

As described above in the powder filling step of the embodiment 1, the green powder GP is manufactured by spraying and drying base slurry for forming by a spraying and drying method or the like. Thus, the green powder is adjusted so as to contain moisture within a range of 1.5% or less by weight by adjustment of conditions at the time of spraying and drying (for example, drying temperature, spraying velocity, etc.). For this reason, if the green powder GP is excessively compressed, a consolidated aggregate is easily generated.

In the powder filling step, the charged green material GP is deposited upward from the lower portion of the die 80 within the cavity 83. After a predetermined amount of green powder GP is filled into the cavity 83, the next step is carried out.

Cavity Blocking Step

In a cavity blocking step, similar to the embodiment 3, as shown in FIG. 5, the press pin 50 is inserted to reach the final position E. Concurrently, the opening 89 is blocked as a rear end of the press pin 50 integrated with the upper holder portion 86 is fitted into the opening 89. Accordingly, the inside of the cavity 83 is brought into a sealed state. Here, since the green powder GP is adjusted such that the moisture content thereof is within a predetermined range as described above, the green powder is not brought into a dried loose state. For this reason, when the press pin 50 is moved toward the tip side in the axial direction within the green powder GP, the press pin 50 receives a resistance having a certain degree of magnitude from the green powder GP. In this case, the stepped portion 53 is moved toward the tip in the axial direction by the stroke F, while compressing the green powder GP.

Compression Molding Step

In the compression molding step, similar to the embodiment 1, as shown in FIG. 5, the green powder GP within the cavity 83 is pressed along with the press pin 50 to obtain the compact PC.

Die Releasing Step

In the die releasing step, similarly to the embodiment 1, as shown in FIG. 6, the compact PC along with the press pin 50 is removed from the cavity 83.

Press Pin Removing Step

In the press pin removing step, similar to the embodiment 1, as shown in FIG. 7, the press pin 50 is pulled out from the compact PC.

The compact PC which has completed the above respective steps and from which the press pin 50 has been extracted, similar to the embodiment 1, is cut and sintered into the insulator 2, and is assembled to the spark plug 100.

In the method for manufacturing an insulator according to the embodiment 3, the press pin 50 has the first shaft portion 51, the second shaft portion 52, and the stepped portion 53 as described above. Further, as described above, the press pin arranging step is carried out before the powder filling step, such that the press pin 50 is arranged within the cavity 83 while the gap S3 is secured. Next, in the powder filling step, the green powder GP is charged into the cavity 83 from the gap S3 and filled into the cavity 83 around the press pin 50 arranged within the cavity 83. Accordingly, in the subsequent cavity blocking step, the press pin 50 can be inserted to reach the final position E by a very short distance, i.e. the stroke F. Consequently, during the cavity blocking step, the resistance that the press pin 50 receives from the green powder GP can be made significantly small.

Accordingly, the manufacturing method of the embodiment 3 can also exhibit the same operational effects as the manufacturing method of the embodiment 1.

In this manufacturing method according to the embodiment 3, the stroke F by which the stepped portion 53 is moved toward the tip side in the axial direction, while the green powder GP is compressed, is shorter than the axial length T of the first shaft portion 51. Accordingly, excessive compression of the green powder GP nearer the tip side than the stepped portion 53 is prevented, and generation of the consolidated aggregate is also prevented. For this reason, the variation in density of the green powder GP is unlikely to occur around the first shaft portion 51, the second shaft portion 52, and the stepped portion 53 within the cavity 83. Consequently, a defect, such as a pinhole, is not generated in the insulator 2 obtained through the compression molding step, and the occurrence of deteriorating insulating performance is prevented. Further, in the manufacturing method of the embodiment 3, the green powder GP around the first shaft portion 51 is appropriately compressed and densified in the axial direction by the stepped portion 53 when the stepped portion 53 is moved by stroke F. Therefore, a defect is not generated at a tip small-diameter portion 2*a* (shown in FIG. 1) of the insulator 2, or between the tip small-diameter portion 2*a* and a tip-side middle-diameter portion 2*b* (shown in FIG. 1). The tip small-diameter portion 2*a* is located on the tip side in the axial direction of the insulator 2, and is formed in a thin-walled cylindrical shape with a taper. The central electrode 3 is arranged at the inner peripheral side of the tip small-diameter portion 2*a*. The tip-side middle-diameter portion 2*b* is located nearer the rear end side in the axial direction than the tip small-diameter portion 2*a* in the insulator 2, and is formed in a thick-walled cylindrical shape having a larger diameter than the tip small-diameter portion 2*a*. A rear end in the axial direction of the central electrode 3 and the resistor 15 are arranged at the inner peripheral side of the tip-side middle-diameter portion 2*b*. Tip small-diameter portion 2*a* is offset relative to the tip-side middle-diameter portion 2*b*, thereby forming a step portion having a changing wall thickness. A defect is not generated at the tip small-diameter portion 2*a* of the insulator 2 and between the tip small-diameter portion 2*a* and the tip-side middle-diameter portion 2*b*, having such a configuration. Consequently, the insulating performance of the insulator 2 can be further improved.

According to this manufacturing method, the taper angle of the tapered stepped portion 53 can be adjusted suitably to control the resistance that the stepped portion 53 receives from the green powder GP and the degree of compression that the stepped portion 53 compresses the green powder GP around the first shaft portion 51, when the stepped portion 53 is moved toward the tip side in the axial direction in the cavity blocking step. Specifically, the taper angle of the stepped portion 53 is preferably about 20° to 70°.

A test example for conforming the operational effects of the embodiment 3 was carried out as follows.

Test Example

In a test example, an aggregate which was formed by consolidating the green powder GP was prepared. The particle diameter of the green GP was about 50 to 160 μm, whereas the particle diameter of the prepared aggregate was about 2 to 5 mm. In the powder filling step, the aggregate was intentionally mixed with the green powder GP to be filled into the cavity 83. Then, five test articles 1-1 and five test articles 1-2 as the insulator 2 were obtained by carrying out the above respective steps. In this case, to obtain the test articles 1-1, the aggregate was mixed in a region within the cavity 83 corresponding to the tip-side middle-diameter portion 2*b* of the insulator 2. To obtain the test articles 1-2, the aggregate was mixed in a region within the cavity 83 corresponding to the large-diameter portion 2*c* (shown in FIG. 1) of the insulator 2. The large-diameter portion 2*c* is located nearer the rear end side in the axial direction than the tip-side middle-diameter portion 2*b* in the insulator 2, and is formed in a flange shape having a larger diameter than the tip-side middle-diameter portion 2*b*. Further, ten test articles 1-3 which are standard articles in which the aggregate was not mixed with the green powder GP in the powder filling step were also prepared.

Figure 16:
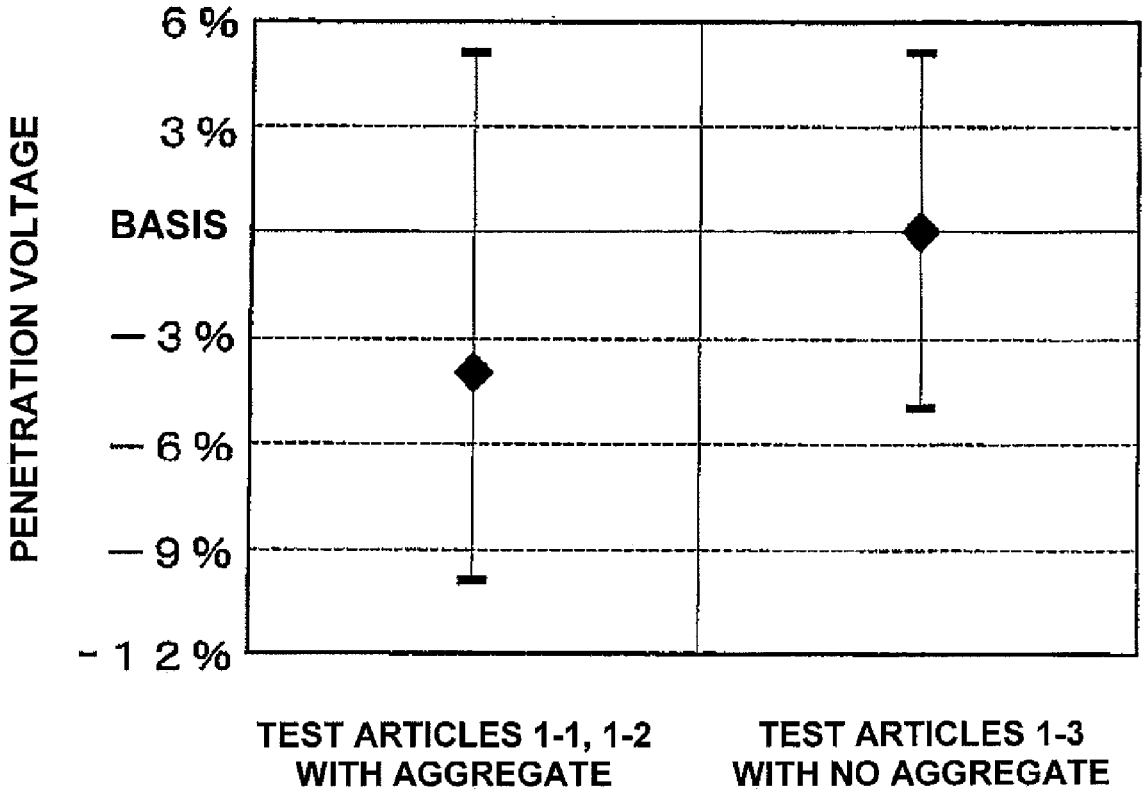
FIG. 16 is a graph illustrating a test example for explaining an effect the embodiment 3 of the present invention.

Next, as for the test articles 1-1 to 1-3, the penetration voltage in the tip small-diameter portion 2*a* was measured. Specifically, a rod-shaped electrode for testing was inserted into the through hole 6 of an insulator 2 to which neither the center electrode 3 nor the terminal electrode 13 was assembled and on the surface of which glaze was not formed. An annular electrode (a metal plate having a through-hole into which the tip small-diameter portion 2*a* is insertable and which can receive the tip small-diameter portion 2*a*) was arranged at the outer peripheral side of the tip small-diameter portion 2*a* A high voltage was applied between the rod-shaped electrode and the annular electrode such that the voltage is changed from the low-voltage side to the high-voltage side, and a voltage at which the insulation by the tip small-diameter portion 2*a* is broken down (that is, penetration voltage of the insulator) was measured. The voltage values measured and acquired are shown in FIG. 16 as an average voltage value and a fluctuation. Specifically, the left side of FIG. 16 (with aggregate) shows an average voltage value and a fluctuation of a total of ten test articles of the five test articles 1-1 and the five test articles 1-2, and the right side of FIG. 16 (with no aggregate) shows an average voltage value and a fluctuation of the ten test articles (standard articles) 1-3.

As shown in FIG. 16, in the test articles 1-3 which are standard articles, the fluctuation of the penetration voltages fell within a range of about ±5% on the basis of the average value of ten penetration voltages. In contrast, in the test articles 1-1 and 1-2 in which an aggregate was mixed, the average value of penetration voltages was about 4% lower than the average value of the standard articles, and on the basis of the average value of the standard articles, the fluctuation to a lower penetration voltage side was about −10% which was quite low (in addition, a highest penetration voltage measured from the test articles 1-1 and 1-2 was equal to that measured from the standard articles 1-3).

It was found from this test example that if an aggregate is mixed during the manufacture of an insulator 2, the resultant insulator 2 may have a low penetration voltage. According to the manufacturing method of the embodiment 3, an aggregate which can cause lowering of a penetration voltage is not mixed, and therefore an insulator that has high insulating performance and that is formed with the straight through hole 6 can be manufactured. In addition, bending of the press pin is prevented, and high yield can be secured.

Although the present invention has been described with reference to the embodiment 1 to 3, the present invention is not limited to the embodiments 1 to 3, and can be properly changed and applied without departing from the spirit or scope thereof.

For example, in the manufacturing method of the embodiment 3, the press pin 250 and the upper holder portion 286 of the embodiment 2 may be adopted instead of the press pin 50 and the upper holder portion 88. In this case, although illustration is omitted, the press pin 250 is stopped at a position axially away from the final position E by the stroke F that is shorter than the axial length T of the first shaft portion 51 in the press pin arranging step. Further, the upper holder portion 286 is positioned to form the gap S2 in the vertical direction between the upper holder portion 286 and the opening 89. In the cavity blocking step, the press pin 250 is inserted to reach the final position E, and then, the upper holder portion 286 is moved downward to block the opening 89. Such a manufacturing method can exhibit the same operational effects as those of the manufacturing method of the embodiment 3.

As discussed above, the present invention can provide at least the following illustrative, non-limiting embodiments:

(1) A method for manufacturing an insulator for a spark plug in which a through hole for inserting a center electrode and a terminal electrode is formed in an axial direction, the method including: a preparing step of preparing a press pin to be used to form the through hole, and a forming die having a cavity in which an opening is formed on the rear end side in the axial direction; a press pin arranging step of arranging the press pin within the cavity by advancing the press pin toward the tip side in the axial direction from the opening; a powder filling step of loading and filling green powder into the cavity from the opening after the press pin arranging step; a cavity blocking step of blocking the opening by a blocking member after the powder filling step; a compression molding step of pressing the green powder within the cavity along with the press pin to obtain a compact, after the press pin arranging step; a die releasing step of releasing the compact along with the press pin from the cavity after the compression molding step; and a press pin removing step of pulling the press pin out of the compact after the die releasing step.

According to the manufacturing method of (1), the press pin arranging step is carried out before the powder filling step. For this reason, bending of the press pin is prevented. For this reason, a hole of the compact, formed by the press pin, extends straight in the axial direction, and therefore the through hole of the insulator for a spark plug also extends straight in the axial direction.

Accordingly, even if the diameter of the insulator for a spark plug is made small, generation of defective articles can be reduced, and replacement frequency of the press pin can be reduced. Therefore, it is possible to guarantee high yield and realize low manufacturing cost.

(2) The manufacturing method of (1), wherein the blocking member and the press pin are coupled integrally, the press pin is stopped before reaching a final position in the press pin arranging step to secure a gap, through which the green powder can be loaded into the cavity between the blocking member and the opening, and the press pin is moved to the final position to block the opening by the blocking member in the cavity blocking step.

According to the method of (2), the blocking member and the press pin are moved integrally. In the press pin arranging step, the press pin stops before the final position within the cavity. Thus, the gap between the blocking member and the opening of the forming die is secured. Here, the final position is the position of the tip of the press pin arranged when the compression molding step is performed. For this reason, in the powder filling step, it is possible to load and fill the green powder into the cavity from the gap between the blocking member and the opening of the forming die. When the press pin is moved to the final position in the cavity blocking step, the blocking member is also moved integrally with the press pin, and blocks the opening. Because most of the press pin is arranged within the cavity before the powder filling step, the resistance that the press pin receives from the green powder within the cavity when the press pin is moved to the final position is small, and therefore bending of the press pin is prevented. Accordingly, the operational effects can be realized by a simple configuration.

The expression "stopped before reaching the final position" is intended to mean stopping the press pin at a position as close to the final position as possible within a range in which green powder can be filled into the cavity though the gap between the blocking member and the opening of the forming die. Preferably, the press pin is stopped at a position distanced from the final position by about 5 mm to about 20 mm (about 4 times to 16 times the external diameter of the press pin).

In addition, the expression "the blocking member and the press pin are coupled integrally" includes a case where both are separate members which can be separated from each other but are moved integrally in addition to a case where both are an integral article.

(3) The manufacturing method of (1), wherein the press pin has a first shaft portion formed on the tip side in the axial direction, a second shaft portion formed nearer the rear end side in the axial direction than the first shaft portion and having a larger diameter than the first shaft portion, and a stepped portion formed between the first shaft portion and the second shaft portion, wherein, in the press pin arranging step, the press pin is stopped at a position distanced from the final position by a stroke that is shorter than an axial length of the first shaft portion, and wherein, in the cavity blocking step, the press pin is moved to the final position and the blocking member concurrently or subsequently blocks the opening.

According to the method of (3), in the press pin arranging step, the press pin is stopped at the position distanced from the final position by the stroke that is shorter than the axial length of the first shaft portion. In this case, the blocking member may be adapted to move integrally with the press pin, and may be adapted to move independently from the press pin.

In the case where the blocking member is adapted to move integrally with the press pin, the press pin integrated with the blocking member stops before reaching the final position, and therefore it is possible to secure the gap between the blocking member and the opening of the forming die. The green powder can be filled into the cavity through the gap. When the press pin is moved to reach the final position in the cavity blocking step, the blocking member integrated with the press pin is concurrently moved to block the opening.

In the case where the blocking member is adapted to move independently from the press pin, in the powder filling step, it is possible to fill the green powder into the cavity from the opening of the forming die. In the cavity blocking step, the press pin is moved to reach the final position, and thereafter the blocking member is moved independently from the press pin to block the opening of the forming die.

When the press pin is moved to reach the final position in the cavity blocking step, a stepped portion of the press pin between first and second shaft portions thereof is moved toward the tip side in the axial direction while compressing the green powder by a stroke shorter than the axial length of the first shaft portion.

In a case of a manufacturing method, in which the press pin arranging step is carried out after the powder filling step, the press pin is moved toward the tip side in the axial direction from the opening after the powder filling step to arrange the press pin within the cavity. For this reason, the stroke by which the press pin is moved toward the tip side in the axial direction while compressing the green powder is significantly longer than the axial length of the first shaft portion. According to the inventors' investigation, this is one of the causes that the green powder nearer the tip side than the stepped portion may be compressed excessively, and the consolidated aggregate may be generated. The aggregate is scattered around the first shaft portion, the stepped portion, and the second shaft portion within the cavity, and the variation in density of the green powder is likely to occur around the aggregate. As a result, a defect, such as a pinhole, occurs in the insulator obtained through the compression molding step, etc., and deterioration of insulating performance occurs. In more detail, the first shaft portion forms a hole which becomes part of a through hole within a so-called tip small-diameter portion of the insulator for a spark plug, and the second shaft portion forms a pinhole which become the rest of the through hole within a tip-side middle-diameter portion, a large-diameter portion and a rear side portion (situated in the rear side from those portion) of the insulator for a spark plug. Therefore, a defect is easily generated at the tip small-diameter portion, or between the tip small-diameter portion and the tip-side middle-diameter portion. Since the insulator for a spark plug is thin-walled at the tip small-diameter portion and is also thin-walled between the tip small-diameter portion and the tip-side middle-diameter portion, insulating performance may deteriorate due to a defect generated in these portions.

In this regard, according to the manufacturing method of (3), the stroke by which the press pin is moved toward the tip side in the axial direction while compressing the green powder is shorter than the axial length of the first shaft portion. According to the inventors' investigation, this is effective in that excessive compression of the green powder nearer the tip side than the stepped portion is prevented, and generation of the consolidated aggregate is prevented. For this reason, the variation in density of the green powder is prevented around the first shaft portion, the stepped portion, and the second shaft portion within the cavity. As a result, occurrence of a defect, such as a pinhole, is prevented in the insulator obtained through the compression molding step, etc., and deterioration of insulating performance is prevented. Further, according to the manufacturing method of (3), the green powder around the first shaft portion is appropriately compressed and densified in the axial direction by the stepped portion when the stepped portion is moved by the stroke. Therefore, generation of a defect is prevented at a small-diameter portion of the tip of the insulator, or between the tip small-diameter portion and a tip-side middle-diameter portion.

(4) The method of (3), wherein, the stepped portion preferably has a tapered shape. According to the method of (4), the resistance that the stepped portion receives from the green powder when the stepped portion is moved toward the tip side in the axial direction can be relaxed, and the degree of the compression of the green powder around the first shaft portion can be easily adjusted.

(5) The method of (3) or (4), wherein the blocking member has an insertion hole formed in the axial direction, and the press pin is movable within the through hole, and, in the cavity blocking step, the press pin is moved to the final position, and thereafter the blocking member is moved toward the tip side in the axial direction. According to the method of (5), a configuration in which the blocking member is movable independently from the press pin can be easily realized. That is, the blocking member and the press pin can be configured as independently movable, separate members to provide a process in which the press pin reaches the final position and thereafter the blocking member reaches a position where the blocking member blocks the cavity.

(6) The manufacturing method of (1), wherein the blocking member has an insertion hole formed in the axial direction, and the press pin is movable within the through hole, and the press pin is moved to the final position in the press pin arranging step, and the blocking member is moved toward the tip side in the axial direction in the cavity blocking step.

According to the method of (6), the press pin can be moved independently from the blocking member, and in the press pin arranged step, the press pin can be arranged in the final position within the cavity. The "final position" is as mentioned above. For this reason, in the powder filling step, it is possible to load and fill the green powder into the cavity from the opening. In the cavity blocking step, the press pin can be moved independently from the press pin to block the opening of the forming die. In the cavity blocking step, the press pin does not receive resistance from the green powder, and bending of the press pin is prevented. Accordingly, the operational effects can be realized reliably.

(7) The method of (5) or (6), wherein the blocking member is obtained by assembling plural split members so as to surround the press pin, and the split members constitute an integral annular member at least in the blocking step. As a concrete configuration in which the press pin is provided so as to be movable within the insertion hole, any arbitrary configurations may be adopted so long as they exhibit the operational effects of the present invention. In a case where the blocking member is constructed as in the method of (7), the insertion hole can expands as the split members surrounding the press pin are separated from each other radially outward of the press pin. For this reason, even if a portion of an outer peripheral surface of the press pin is thicker than the insertion hole, the press pin can be moved without any difficulty within the insertion hole. In the cavity blocking step, since the split members can constitute an integral annular member to block the opening, high sealing performance of the cavity can be achieved.

The configuration of the above blocking member is particularly effective in a case where that a pin-side spiral portion is formed on the rear end side of the press pin. In this case, the compact is formed with a compact-side spiral portion to which the pin-side spiral portion is transferred by the compression molding step. For this reason, in a press pin removing step after the die releasing step, in which the press pin is retreated relative to the compact while being rotated around an axis, the press pin can be pulled out of the compact easily. Since the pin-side spiral portion of the press pin can be moved without any difficulty within the insertion hole whose diameter has been increased, the size of a manufacturing apparatus can be reduced.

(8) The manufacturing method of any one of (1) to (7), wherein, a bottom of the cavity opposite the opening is formed with a positioning portion which positions the radial position of a tip of the press pin. The positioning portion is, for example, a recess into which the tip of the press pin fits. According to the method of (8), since the tip of the press pin is constrained so as not to be displaced in the radial direction, bending of the press pin is prevented.

(9) A method for manufacturing a spark plug, which includes a step of manufacturing an insulator for the spark plug by the method of any one of (1) to (8), and a step of assembling the manufactured insulator with other constituent members. According to the method of (9), since the spark plug obtained by this manufacturing method can enjoy the operational effects described above, high yield can be guaranteed, and low manufacturing cost can be realized.

What is claimed is:

1. A method for manufacturing an insulator for a spark plug, the method comprising:

a preparing step of preparing a press pin and a forming die having a cavity extending in an axial direction, the forming die defining a rear end side in the axial direction and an opposite, tip side in the axial direction and further having an opening of the cavity in the rear end side;

a press pin arranging step of arranging the press pin within the cavity by advancing the press pin toward the tip side of the forming die in the axial direction from the opening;

a powder filling step of filling powder into the cavity from the opening;

a cavity blocking step of blocking the opening with a blocking member;

a compression molding step of pressing the powder and the press pin within the cavity to form a compact, said compact integrating with the press pin;

a die releasing step of releasing the integrated compact and press pin from the cavity;

a press pin removing step of removing the press pin from the integrated compact after the die releasing step to obtain the compact having a hole extending in the axial direction, wherein the press pin has a first shaft portion at the tip thereof and having a predetermined length in the axial direction, a second shaft portion at the rear end side of the first shaft portion and having a larger diameter than the first shaft portion and a stepped portion located between the first shaft portion and the second shaft portion, wherein, in the press pin arranging step, the press pin is stopped at a position distanced from a final position by a stroke that is shorter than the axial length of the first shaft portion, and wherein, in the cavity blocking step, the press pin is moved by the stroke to reach the final position so that the blocking member concurrently or subsequently blocks the opening.

2. The method according to claim 1, wherein the blocking member and the press pin are coupled integrally, in the press pin arranging step, the press pin is stopped before reaching a final position to secure a gap between the blocking member and the opening, in the powder filling step, the powder is filled into the cavity through the gap, and in the cavity blocking step, the press pin is moved to reach the final position so that the blocking member blocks the opening.

3. The method according to claim 1, wherein the stepped portion is tapered.

4. The method according to claim 1, wherein the blocking member has an insertion hole, through which the press pin passes, wherein the press pin is movable relative to the blocking member, and wherein, in the cavity blocking step, the press pin is moved to reach the final position, and thereafter the blocking member is moved relative to the press pin to block the opening.

5. The method according to claim 1, wherein the blocking member includes plural split members arranged to surround the press pin and wherein, at least in the cavity blocking step, the split members are moved to contact one another to form an integral annular member.

6. The method according to claim 1, wherein a positioning portion is provided at a bottom of the cavity opposite to the opening, and wherein, in the press pin arranging step, the positioning portion receives a tip of the press pin to radially position the tip of the press pin.

7. A method for manufacturing a spark plug comprising:

obtaining an insulator by the method comprising:

a preparing step of preparing a press pin and a forming die having a cavity extending in an axial direction, the forming die defining a rear end side in the axial direction and an opposite, tip side in the axial direction and further having an opening of the cavity in the rear end side;

a press pin arranging step of arranging the press pin within the cavity by advancing the press pin toward the tip side of the forming die in the axial direction from the opening;

a powder filling step of filling powder into the cavity from the opening;

a cavity blocking step of blocking the opening with a blocking member;

a compression molding step of pressing the powder and the press pin within the cavity to form a compact, said compact integrating with the press pin;

a die releasing step of releasing the integrated compact and press pin from the cavity; and a press pin removing step of removing the press pin from the compact after the die releasing step to obtain the compact having a hole extending in the axial direction; and a step of assembling the insulator with members including a center electrode and a terminal electrode, wherein the press pin has a first shaft portion at the tip thereof and having a predetermined length in the axial direction, a second shaft portion at the rear end side of the first shaft portion and having a larger diameter than the first shaft portion and a stepped portion located between the first shaft portion and the second shaft portion, wherein, in the press pin arranging step, the press pin is stopped at a position distanced from a final position by a stroke that is shorter than the axial length of the first shaft portion, and wherein, in the cavity blocking step, the press pin is moved by the stroke to reach the final position so that the blocking member concurrently or subsequently blocks the opening.

8. A method for manufacturing an insulator for a spark plug, the method comprising: a preparing step of preparing a press pin and a forming die having a cavity extending in an axial direction, the forming die defining a rear end side in the axial direction and an opposite, tip side in the axial direction and further having an opening of the cavity in the rear end side; a press pin arranging step of arranging the press pin within the cavity by advancing the press pin toward the tip side of the forming die in the axial direction from the opening; a powder filling step of filling powder into the cavity from the opening; a cavity blocking step of blocking the opening with a blocking member; a compression molding step of pressing the powder and the press pin within the cavity to form a compact, said compact integrating with the press pin; a die releasing step of releasing the integrated compact and press pin from the cavity; and a press pin removing step of removing the press pin from the integrated compact after the die releasing step to obtain the compact having a hole extending in the axial direction, wherein the blocking member has an insertion hole, though which the press pin passes, wherein the press pin is movable relative to the blocking member, wherein, in the press pin arranging step, the press pin is moved to reach a final position, wherein, in the cavity blocking step, the blocking member is moved relative to the press pin to block the opening, wherein a positioning portion is provided at a bottom of the cavity opposite to the opening, and wherein, in the press pin arranging step, the positioning portion receives a tip of the press pin to radially position the tip of the press pin.

9. A method for manufacturing an insulator for a spark plug, the method comprising:

a preparing step of preparing a press pin and a forming die having a cavity extending in an axial direction, the forming die defining a rear end side in the axial direction and an opposite, tip side in the axial direction and further having an opening of the cavity in the rear end side;

a press pin arranging step of arranging the press pin within the cavity by advancing the press pin toward the tip side of the forming die in the axial direction from the opening;

a powder filling step of filling powder into the cavity from the opening;

a cavity blocking step of blocking the opening with a blocking member;

a compression molding step of pressing the powder and the press pin within the cavity to form a compact, said compact integrating with the press pin;

a die releasing step of releasing the integrated compact and press pin from the cavity; and a press pin removing step of removing the press pin from the integrated compact after the die releasing step to obtain the compact having a hole extending in the axial direction, wherein a positioning portion is provided at a bottom of the cavity opposite to the opening, and wherein, in the press pin arranging step, the positioning portion receives a tip of the press pin to radially position the tip of the press pin.

* * * * *